US010317123B1

(12) United States Patent
Wohlers

(10) Patent No.: US 10,317,123 B1
(45) Date of Patent: Jun. 11, 2019

(54) SHARED EVAPORATOR SYSTEM

(71) Applicant: Sub-Zero, Inc., Madison, WI (US)

(72) Inventor: Elizabeth Wohlers, Stoughton, WI (US)

(73) Assignee: SUB-ZERO, INC., Madison, WI (US)

( * ) Notice: Subject to any disclaimer, the term of this patent is extended or adjusted under 35 U.S.C. 154(b) by 0 days.

(21) Appl. No.: 15/953,706

(22) Filed: Apr. 16, 2018

(51) Int. Cl.

| | |
|---|---|
| ***F25D 11/02*** | (2006.01) |
| ***F25D 17/06*** | (2006.01) |
| ***F25D 17/08*** | (2006.01) |
| ***F25D 23/06*** | (2006.01) |
| ***F25D 29/00*** | (2006.01) |

(52) U.S. Cl.
CPC ..... *F25D 11/022* (2013.01); *F25D 11/02* (2013.01); *F25D 17/065* (2013.01); *F25D 17/08* (2013.01); *F25D 23/06* (2013.01); *F25D 23/061* (2013.01); *F25D 29/00* (2013.01); *F25D 2317/061* (2013.01); *F25D 2317/066* (2013.01); *F25D 2317/0672* (2013.01); *F25D 2600/04* (2013.01); *F25D 2700/12* (2013.01)

(58) Field of Classification Search
CPC ..... F25D 2317/0682; F25D 17/065; F25D 17/08; F25D 11/02; F25D 23/06; F25D 23/061; F25D 2317/066; F25D 2317/0672; F25D 2317/061
See application file for complete search history.

(56) References Cited

U.S. PATENT DOCUMENTS

| | | | | |
|---|---|---|---|---|
| 3,004,401 | A * | 10/1961 | Mann | F25D 17/065 62/156 |
| 3,090,209 | A * | 5/1963 | Hubacker | F25D 17/065 62/180 |
| 3,394,557 | A * | 7/1968 | Kronenberger | F25D 17/065 62/176.6 |
| 3,403,534 | A * | 10/1968 | Bright | F25D 17/065 62/176.1 |
| 3,411,312 | A * | 11/1968 | Sigl | F25D 17/065 62/180 |
| 4,416,119 | A | 11/1983 | Wilson et al. | |
| 4,876,860 | A * | 10/1989 | Negishi | F25D 17/065 62/179 |

(Continued)

FOREIGN PATENT DOCUMENTS

EP 2568239 A2 * 3/2013 ..... F25D 11/006

*Primary Examiner* — Orlando E Aviles
(74) *Attorney, Agent, or Firm* — Bell & Manning, LLC

(57) ABSTRACT

A refrigerator includes an evaporator, a first fan, a first duct, a first return duct, a second fan, a second duct, and a second return duct. A first temperature sensor measures a first temperature in a first enclosed space. A second temperature sensor measures a second temperature in a second enclosed space. The first duct is mounted between the evaporator and the first enclosed space to receive air from the first duct and move it into the first enclosed space. The first return duct is mounted between the first enclosed space and the evaporator. The second duct is mounted between the evaporator and the second enclosed space to receive air from the second duct and move it into the second enclosed space. The second return duct is mounted between the second enclosed space and the evaporator. A refrigerator controller controls the evaporator and independent operation of both fans.

20 Claims, 22 Drawing Sheets

(56) References Cited

U.S. PATENT DOCUMENTS 5,048,306 A * 9/1991 Wakatsuki ..... F25D 17/045 62/419
5,255,530 A 10/1993 Janke
5,758,512 A * 6/1998 Peterson ..... F25D 17/065 62/407
5,819,552 A * 10/1998 Lee ..... F25D 17/065 62/407
5,899,083 A * 5/1999 Peterson ..... F25D 17/045 62/186
6,038,880 A * 3/2000 Oh ..... F24F 9/00 62/256
6,094,931 A * 8/2000 Jeong ..... F25D 17/065 454/193
6,213,731 B1 4/2001 Doepker et al.
6,655,164 B2 12/2003 Rogstam
6,672,090 B1 1/2004 Healy et al.
6,725,680 B1 4/2004 Schenk et al.
6,931,867 B2 8/2005 Healy et al.
RE40,257 E 4/2008 Doepker et al.
7,665,327 B2 2/2010 Tunzi
8,082,746 B2 12/2011 Yamanaka et al.
8,833,089 B2 9/2014 Tandou et al.
2004/0107726 A1* 6/2004 Kim ..... F25D 17/045 62/441
2004/0261444 A1* 12/2004 Chastine ..... F25D 11/02 62/441
2008/0134708 A1* 6/2008 Lee ..... F25D 17/065 62/340
2008/0156028 A1* 7/2008 Cur ..... F25B 25/00 62/203
2010/0300137 A1* 12/2010 Lim ..... F25D 17/065 62/419
2010/0332048 A1* 12/2010 Lee ..... F25D 29/00 700/300
2011/0011106 A1* 1/2011 Ahn ..... F25D 17/065 62/89
2011/0209490 A1 9/2011 Mijanovic et al.
2012/0174613 A1* 7/2012 Park ..... F25C 5/046 62/320
2013/0312437 A1 11/2013 Davies et al.

* cited by examiner

SHARED EVAPORATOR SYSTEM

BACKGROUND

Refrigerators can be divided into multiple cooling zones that can be controlled independently over the same or different temperature ranges. Each cooling zone is defined by an enclosed space. For example, a refrigerator may include a plurality of refrigerated zones that are designed to operate between 34° Fahrenheit (F) and 42° F. and zero or more freezer zones that are designed to operate below 32° F.

SUMMARY

In an example embodiment, a refrigerator is provided. The refrigerator includes, but is not limited to, a first evaporator, a refrigerator controller, a first compartment, a second compartment, a first temperature control, a second temperature control, a first fan, a first duct, a first return duct, a second fan, a second duct, and a second return duct. The first compartment includes, but is not limited to, a first plurality of walls, a first compartment access structure, and a first temperature sensor. The first compartment access structure is configured to provide access to a first enclosed space defined by the first plurality of walls and the first compartment access structure. The first temperature sensor is configured to measure a first temperature value of air in the first enclosed space and to send the measured first temperature value to the refrigerator controller. The second compartment includes, but is not limited to, a second plurality of walls, a second compartment access structure, and a second temperature sensor. The second compartment access structure is configured to provide access to a second enclosed space defined by the second plurality of walls and the second compartment access structure. The second temperature sensor is configured to measure a second temperature value of air in the second enclosed space and to send the measured second temperature value to the refrigerator controller. The first temperature control is configured to receive a first temperature setting value for the first compartment and to send the received first temperature setting value to the refrigerator controller. The second temperature control is configured to receive a second temperature setting value for the second compartment and to send the received second temperature setting value to the refrigerator controller. The first fan is mounted adjacent to or in the first enclosed space. The first duct is mounted between the first evaporator and the first enclosed space. The first fan is configured to receive air from the first duct and to move the received air into the first enclosed space when on. The first return duct is mounted at least partially between the first enclosed space and the first evaporator. The second fan is mounted adjacent to or in the second enclosed space. The second duct is mounted between the first evaporator and the second enclosed space. The second fan is configured to receive air from the second duct and to move the received air into the second enclosed space when on. The second return duct is mounted at least partially between the second enclosed space and the first evaporator. The refrigerator controller is configured to receive the sent first temperature value, to receive the sent first temperature setting value, to receive the sent second temperature value, to receive the sent second temperature setting value, to control a flow of refrigerant through a coil of the first evaporator based on the received first temperature value, the received first temperature setting value, the received second temperature value, and the received second temperature value setting, and to separately control operation of the first fan and the second fan.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1:
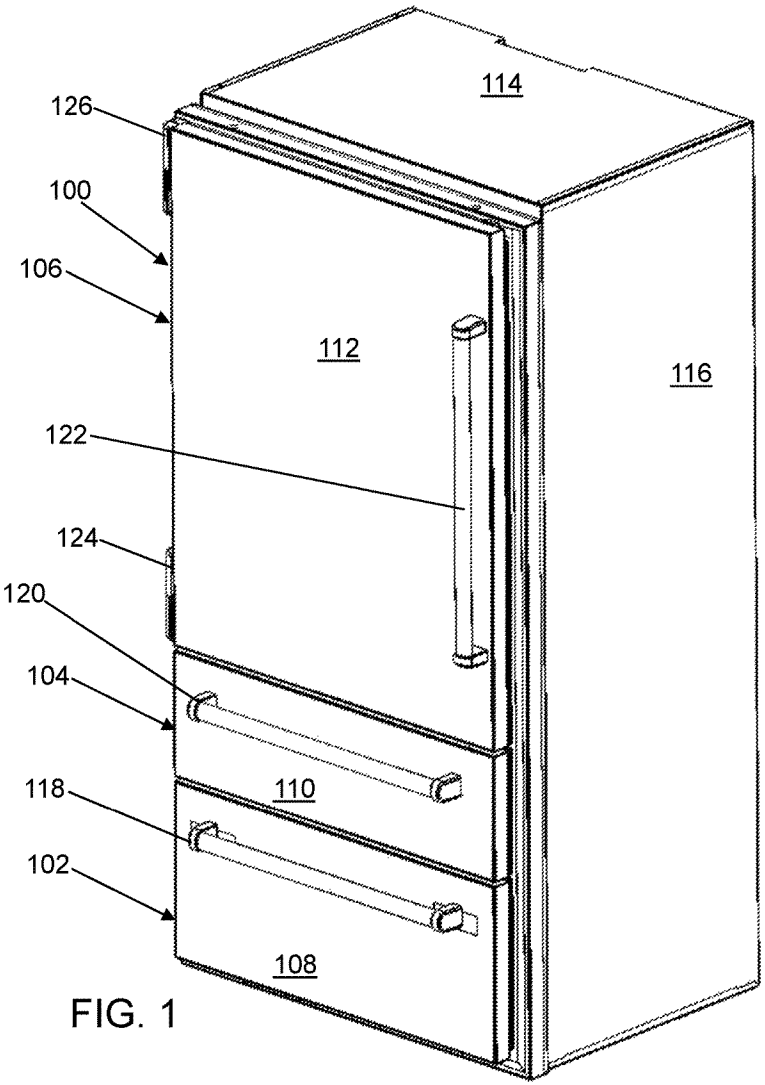
FIG. 1 depicts a right, front, perspective view of a refrigerator in accordance with an illustrative embodiment.
Figure 2:
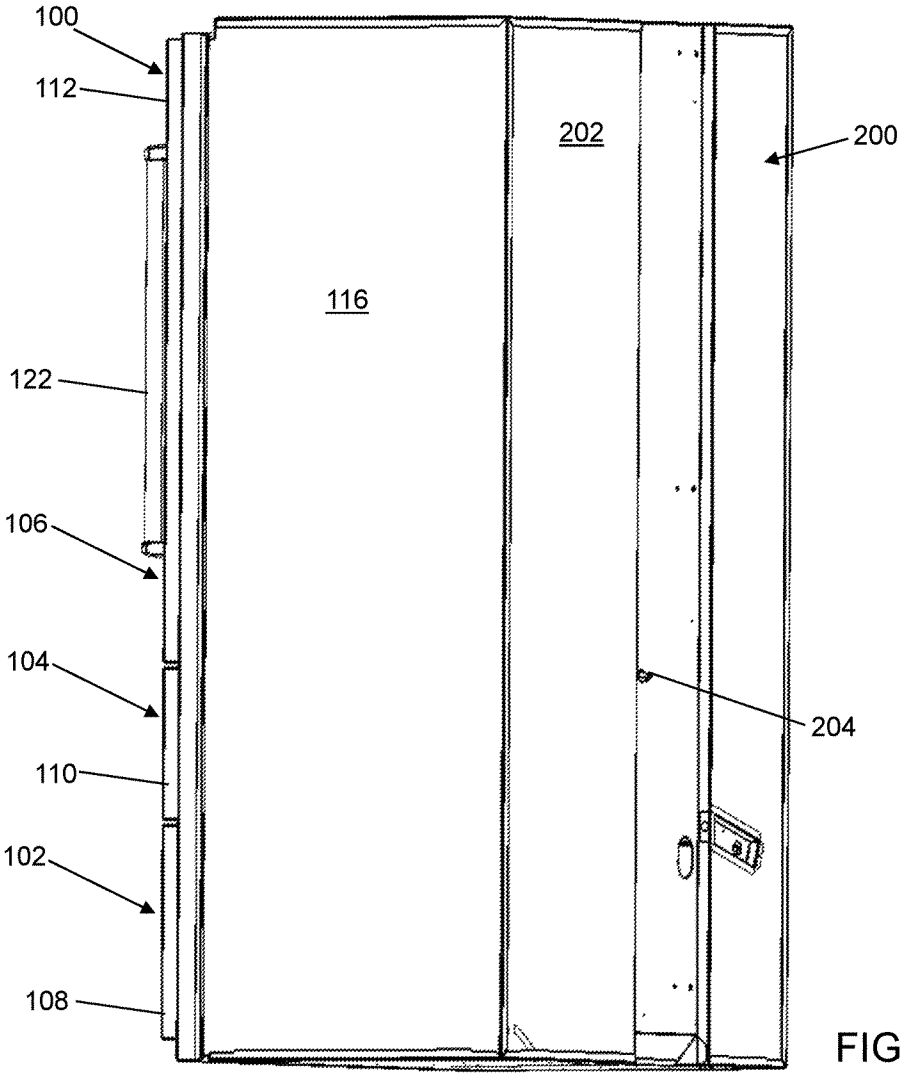
FIG. 2 depicts a right, back, perspective view of the refrigerator of FIG. 1 in accordance with an illustrative embodiment.

Referring to FIG. 1, a right, front, perspective view of a refrigerator 100 is shown in accordance with an illustrative embodiment. Referring to FIG. 2, a right, back, perspective view of refrigerator 100 is shown in accordance with an illustrative embodiment. Refrigerator 100 may include a plurality of compartments or cooling zones. For example, in the illustrative embodiment, refrigerator 100 includes a first compartment 102, a second compartment 104, and a third compartment 106. First compartment 102, second compartment 104, and third compartment 106 are stacked vertically with second compartment 104 above first compartment 102 and below third compartment 106.

Each compartment may provide a freezer zone or a refrigerated zone. For example, in the illustrative embodiment, first compartment 102 may be a freezer zone that is designed to operate below 32° F., for example, based on a selection using a first temperature control 3114 (shown referring to FIG. 31). Second compartment 104 and third compartment 106 may be refrigerated zones that are designed to operate between 34° Fahrenheit (F) and 42° F., for example, based on a selection using a second temperature control 3118 (shown referring to FIG. 31) and a third temperature control 3122 (shown referring to FIG. 31), respectively. In general, a temperature of the refrigerated zone is maintained at an adequate temperature for fresh foods and a temperature of the freezer zone is maintained at an adequate temperature for frozen foods. In alternative embodiments, refrigerator 100 may include a fewer or a greater number of compartments arranged vertically and/or horizontally with respect to each other. For example, refrigerator 100 may include compartments to the right of the illustrated compartments. A wall that separates a pair of compartments may or may not be insulated.

Figure 31:
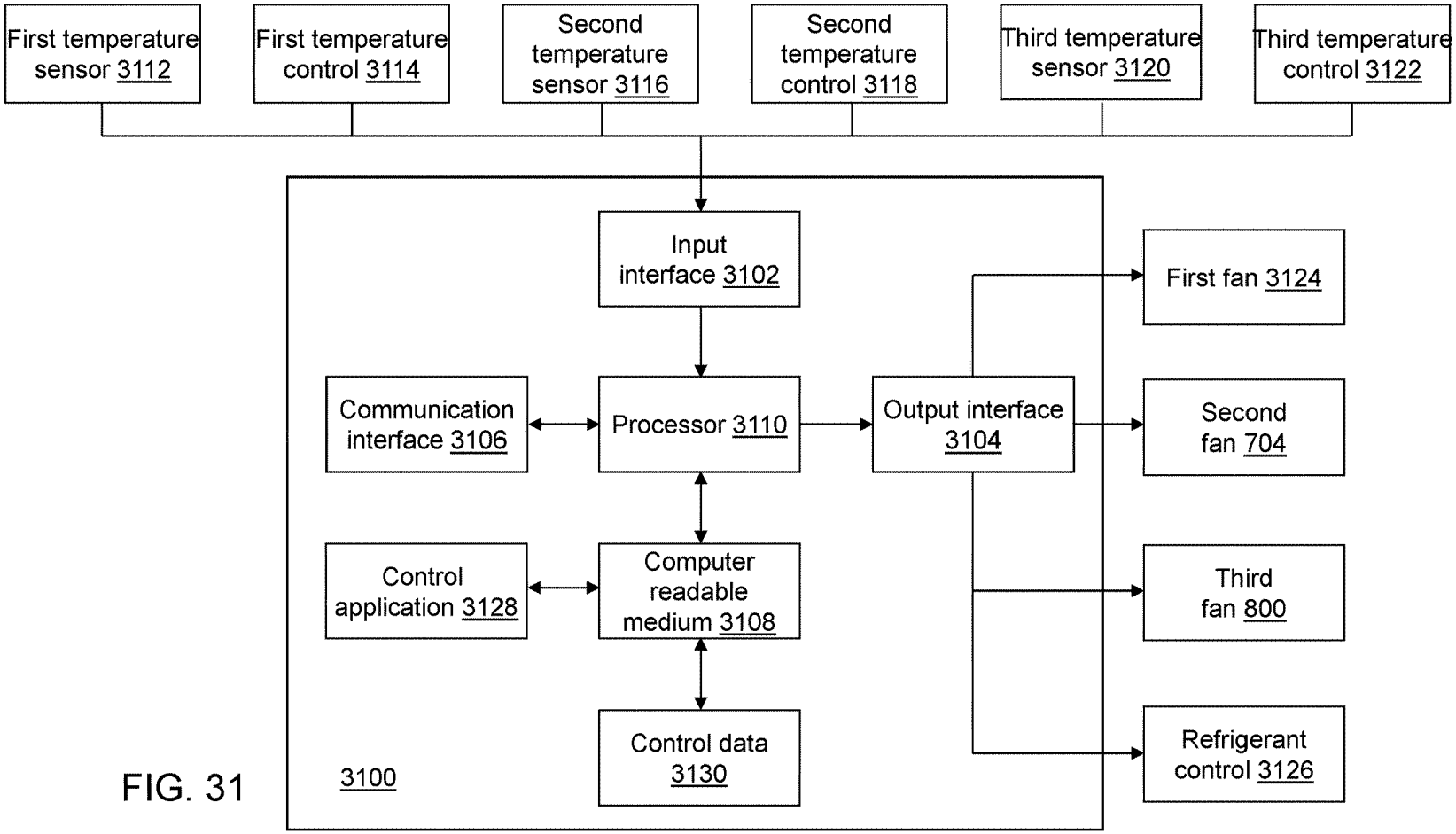
FIG. 31 depicts a block diagram of a refrigerator controller of the refrigerator of FIG. 1 in accordance with an illustrative embodiment.

Each compartment of the plurality of compartments may include a plurality of walls, a compartment access structure configured to provide access to an enclosed space defined by the plurality of walls and the compartment access structure, and a temperature sensor configured to measure a temperature value of air in the enclosed space and to send the measured temperature value to a refrigerator controller 3100 (shown referring to FIG. 31). For example, a first temperature sensor 3112 (shown referring to FIG. 31) may measure a current temperature within first compartment 102; a second temperature sensor 3116 (shown referring to FIG. 31) may measure a current temperature within second compartment 104; and a third temperature sensor 3120 (shown referring to FIG. 31) may measure a current temperature within third compartment 106.

Refrigerator controller 3100 controls a flow of refrigerant through each refrigeration system of refrigerator 100 where a refrigeration system cools air provided to one or more of the plurality of compartments. Refrigerator 100 may include one or more refrigeration systems. For illustration, a refrigeration system may include a compressor, a condenser, an expansion valve, a dryer, and/or an evaporator through which the refrigerant flows as well as various motors that control operation of the refrigeration system components. An air circulation system that includes a fan, an air duct, and/or a return duct may be associated with each compartment to provide cooled air from the associated evaporator to the enclosed space and to return air from the enclosed space to the associated evaporator to maintain the air in the enclosed space at the temperature selected using the associated temperature control. Two or more compartments of the plurality of compartments may share portions of a refrigeration system and an air circulation system.

First compartment 102 may include a first compartment access structure 108 that is a first drawer panel. A first handle 118 is mounted to first compartment access structure 108 to slide a first drawer open for access to a first enclosed space defined by first compartment 102. First compartment access structure 108 may include one or more gaskets to seal the first enclosed space from external air when first compartment access structure 108 is closed. First compartment 102 may include a plurality of drawers that may be stacked vertically and/or horizontally.

Second compartment 104 may include a second compartment access structure 110 that is a second drawer panel. A second handle 120 is mounted to second compartment access structure 110 to slide a second drawer open for access to a second enclosed space defined by second compartment 104. Second compartment access structure 110 may include one or more gaskets to seal the second enclosed space from external air when second compartment access structure 110 is closed. Second compartment 104 may include a plurality of drawers that may be stacked vertically and/or horizontally.

Third compartment 106 may include a third compartment access structure 112 that is a door. A third handle 122 is mounted to third compartment access structure 110 and is used to open the door by rotating it about a first hinge 124 and a second hinge 126 for access to a third enclosed space defined by third compartment 106. Third compartment access structure 112 may be rotatable in either direction about a horizontal axis or a vertical axis defined by first hinge 124 and second hinge 126. In alternative embodiments, the door may be mounted to a refrigerator body 300 (shown referring to FIG. 3) of refrigerator 100 using a greater or a fewer number of hinges of various types. Third compartment access structure 112 may include one or more gaskets to seal the third enclosed space from external air when third compartment access structure 112 is closed.

Figure 3:
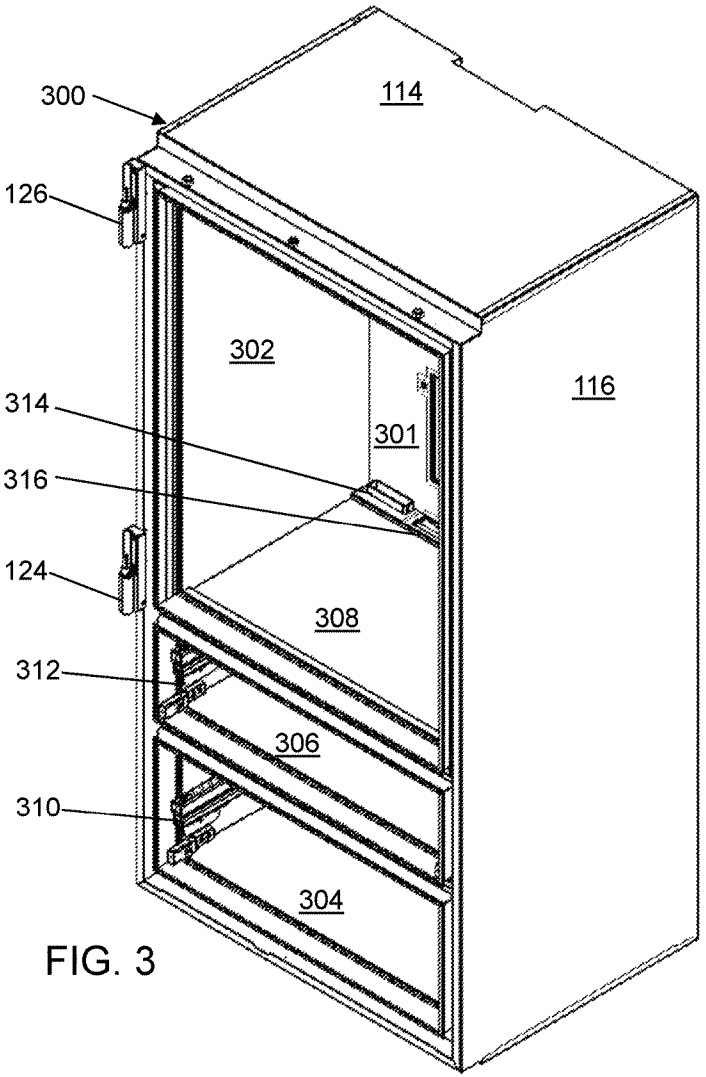
FIG. 3 depicts a right, front, perspective view of the refrigerator of FIG. 1 with doors removed in accordance with an illustrative embodiment.

Referring to FIGS. 1 to 3, refrigerator body 300 may include a top wall 114, a right-side wall 116, a left-side wall 302 (shown referring to FIG. 3), a bottom wall 304 (shown referring to FIG. 3), and a back wall 200 (shown referring to FIG. 2). Each wall may be formed of one or more plates. For each wall comprised of a plurality of plates, the plurality of plates is mounted to each other using various fasteners or fastening methods with electrical wiring, ducts, tubing, sensors, and/or insulation possibly mounted between the plurality of plates. For example, back wall 200 includes an exterior plate 202, a middle plate 301, a first compartment back plate 410 (shown referring to FIG. 4), a second compartment back plate 408 (shown referring to FIG. 4), and a third compartment back plate 400 (shown referring to FIG. 4).

Each compartment of the plurality of compartments may include zero or more shelves, drawers, or other receptacles mounted therein. Zero or more receptacles further may be mounted to each compartment access structure. For example, first compartment 102 and second compartment 104 may include drawer walls that form a receptacle mounted to first compartment access structure 108 and to second compartment access structure 110, respectively, that slide outward with first compartment access structure 108 and with second compartment access structure 110, respectively. Third compartment 106 may include shelves mounted to third compartment access structure 112 that open with third compartment access structure 112 as well as shelves and/or drawers mounted within the third enclosed space. The components of refrigerator 100 including refrigerator body 300 may be formed of one or more materials, such as metal, glass, and/or plastic having a sufficient strength and rigidity and aesthetic value to provide the illustrated and/or described function. For example, the one or more shelves, drawers, or other receptacles may be formed of one or more materials, such as metals, glass, and/or plastics having a sufficient strength and rigidity to support food items or other items stored in refrigerator 100 while providing an attractive appearance.

In the illustrative embodiment, first compartment access structure 108 provides access to first compartment 102 defined by bottom wall 304, right-side wall 116, left-side wall 302, back wall 200, and a first divider wall 306; second compartment access structure 110 provides access to second compartment 104 defined by first divider wall 306, right-side wall 116, left-side wall 302, back wall 200, and a second divider wall 308; and third compartment access structure 112 provides access to third compartment 106 defined by second divider wall 308, right-side wall 116, left-side wall 302, back wall 200, and top wall 114. Bottom wall 304, right-side wall 116, left-side wall 302, back wall 200, and first divider wall 306 define the first enclosed space of first compartment 102. First divider wall 306, right-side wall 116, left-side wall 302, back wall 200, and second divider wall 308 define the second enclosed space of second compartment 104. Second divider wall 308, right-side wall 116, left-side wall 302, back wall 200, and top wall 114 define the third enclosed space of third compartment 106.

First compartment 102 further includes a left-side sliding bracket 310 and a right-side sliding bracket (not shown) on which the first drawer is mounted to slide in and out to provide access to the first enclosed space. Second compartment 104 further includes a left-side sliding bracket 312 and a right-side sliding bracket (not shown) on which the second drawer is mounted to slide in and out to provide access to the second enclosed space. Of course, in alternative embodiments, a door may provide access to the first enclosed space and/or the second enclosed space.

Though shown in the illustrative embodiment as forming a generally rectangular shaped enclosure with generally rectangular shaped components, refrigerator 100 may form any shaped enclosure including other polygons as well as circular or elliptical enclosures. As a result, each compartment access structure and the walls forming refrigerator body 300 and each compartment may have any shape including other polygons as well as circular or elliptical shapes. The refrigeration system components such as the compressor, the condenser, the evaporator, the dryer, etc. may be mounted to various walls of refrigerator body 300 either within the walls, on an exterior of the walls relative to refrigerator body 300, and/or on an interior of the walls relative to refrigerator body 300.

Use of directional terms, such as top, bottom, right, left, front, back, etc. are merely intended to facilitate reference to the various surfaces and elements of the described structures relative to the orientations shown in the drawings and are not intended to be limiting in any manner. For consistency, the components of refrigerator 100 are labeled such that the compartment access structure(s) define a front of refrigerator 100.

As used in this disclosure, the term "mount" is intended to define a structural connection between two or more elements and includes join, unite, connect, couple, associate, insert, hang, hold, affix, attach, fasten, bind, paste, secure, bolt, screw, rivet, solder, weld, glue, adhere, form over, layer, and other similar terms. The phrases "mounted on" and "mounted to" include any interior or exterior portion of the elements referenced. These phrases also encompass direct mounting (in which the referenced elements are in direct contact) and indirect mounting (in which the referenced elements are not in direct contact). Elements referenced as mounted to each other herein may further be integrally formed together, for example, using a molding process as understood by a person of skill in the art. As a result, elements described herein as being mounted to each other need not be discrete structural elements.

Figure 4:
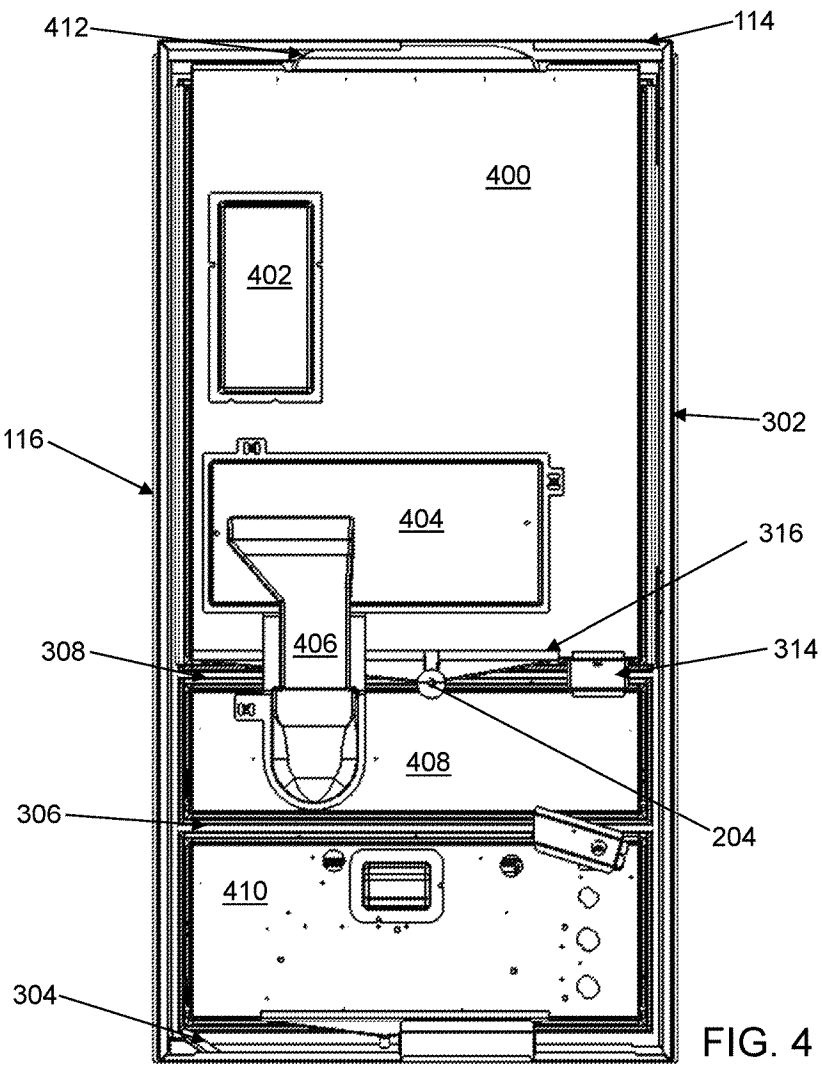
FIG. 4 depicts a back view of the refrigerator of FIG. 1 with a back wall portion removed in accordance with an illustrative embodiment.
Figure 6:
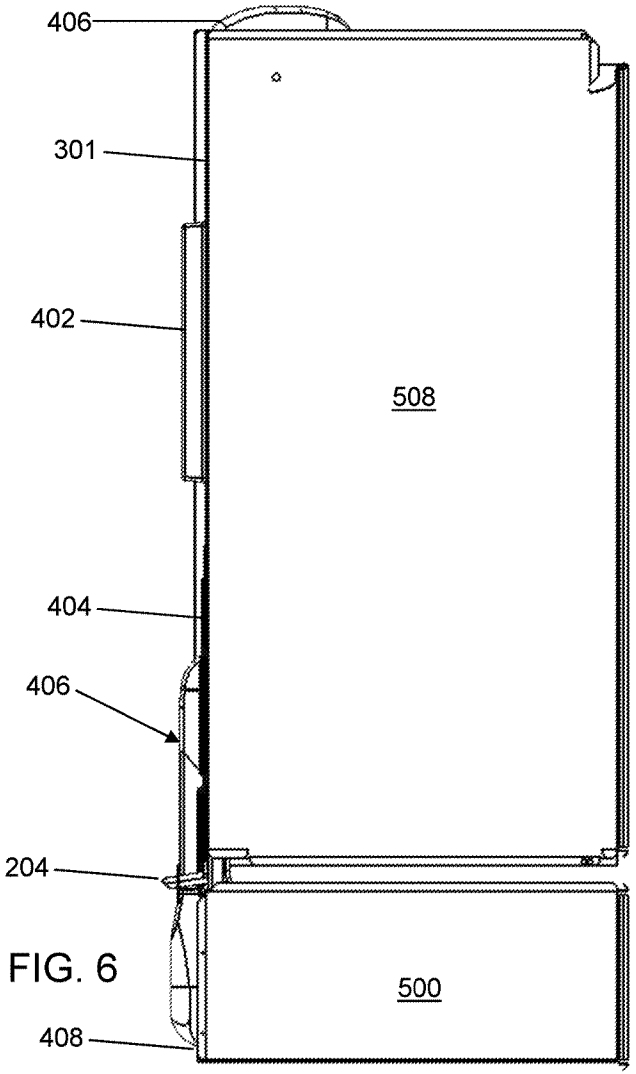
FIG. 6 depicts a left-side view of the refrigerator of FIG. 1 with the doors removed in accordance with an illustrative embodiment.
Figure 5:
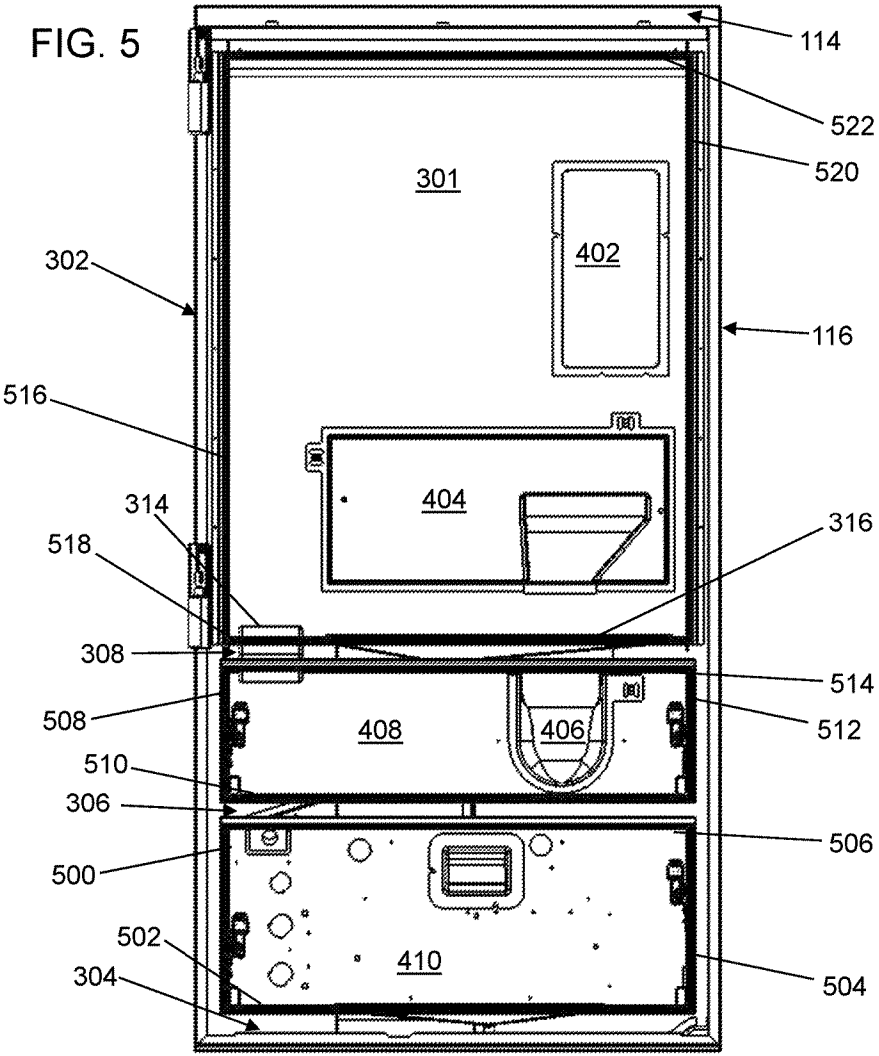
FIG. 5 depicts a front view of the refrigerator of FIG. 1 with the doors removed in accordance with an illustrative embodiment.

With reference to FIG. 4, a back view of refrigerator body 300 is shown with exterior plate 202 and middle plate 301 of back wall 200 removed in accordance with an illustrative embodiment. With reference to FIG. 5, a front view of refrigerator body 300 is shown with third compartment back plate 400 of back wall 200 removed in accordance with an illustrative embodiment. With reference to FIG. 6, a left-side view of refrigerator body 300 is shown with exterior plate 202 and third compartment back plate 400 of back wall 200 removed in accordance with an illustrative embodiment.

In the illustrative embodiment, an air filter mounting plate 402, an evaporator mounting plate 404, and a second compartment air duct 406 are mounted to middle plate 301 and/or third compartment back plate 400. An air filter housing is mounted to air filter mounting plate 402. An air filter may be mounted within the air filter housing to filter air passing therethrough.

Referring to FIGS. 4 and 5, the first enclosed space of first compartment 102 is defined by a first compartment left-side plate 500, a first compartment bottom plate 502, a first compartment right-side plate 504, a first compartment top plate 506, first compartment back plate 410, and first compartment access structure 108. In the illustrative embodiment, first compartment 102 is cooled by a first refrigeration system that includes a first evaporator (not shown), a first compressor (not shown), etc. through a first air circulation system (not shown) that includes a first fan 3124 (shown referring to FIG. 31).

The second enclosed space of second compartment 104 is defined by a second compartment left-side plate 508, a second compartment bottom plate 510, a second compartment right-side plate 512, a second compartment top plate 514, second compartment back plate 408, and second compartment access structure 110. The third enclosed space of third compartment 106 is defined by a third compartment left-side plate 516, a third compartment bottom plate 518, a third compartment right-side plate 520, a third compartment top plate 522, third compartment back plate 400, and third compartment access structure 110.

Figure 7:
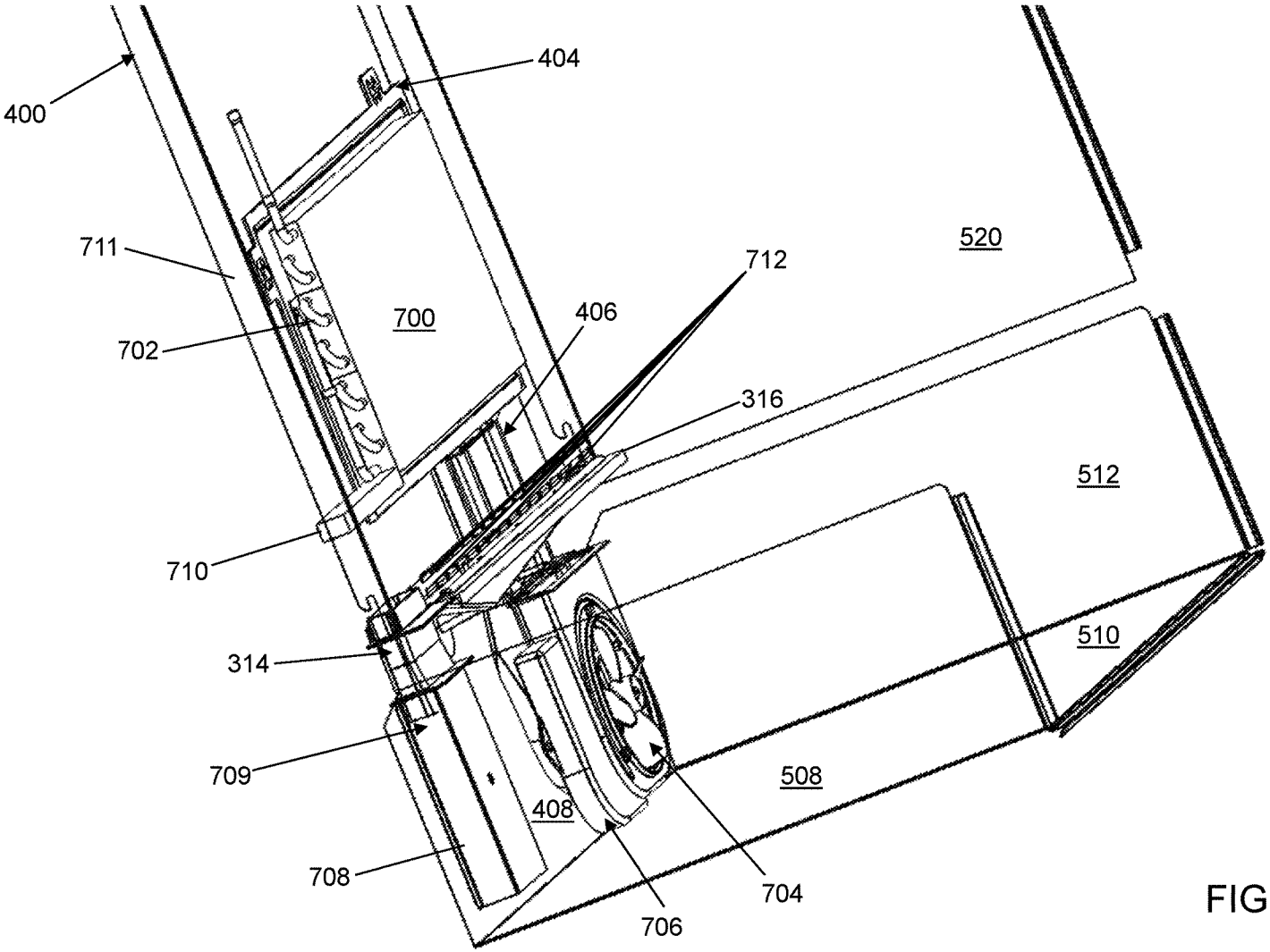
FIG. 7 depicts a left, front perspective view of a first portion of the refrigerator of FIG. 1 in accordance with an illustrative embodiment.
Figure 9:
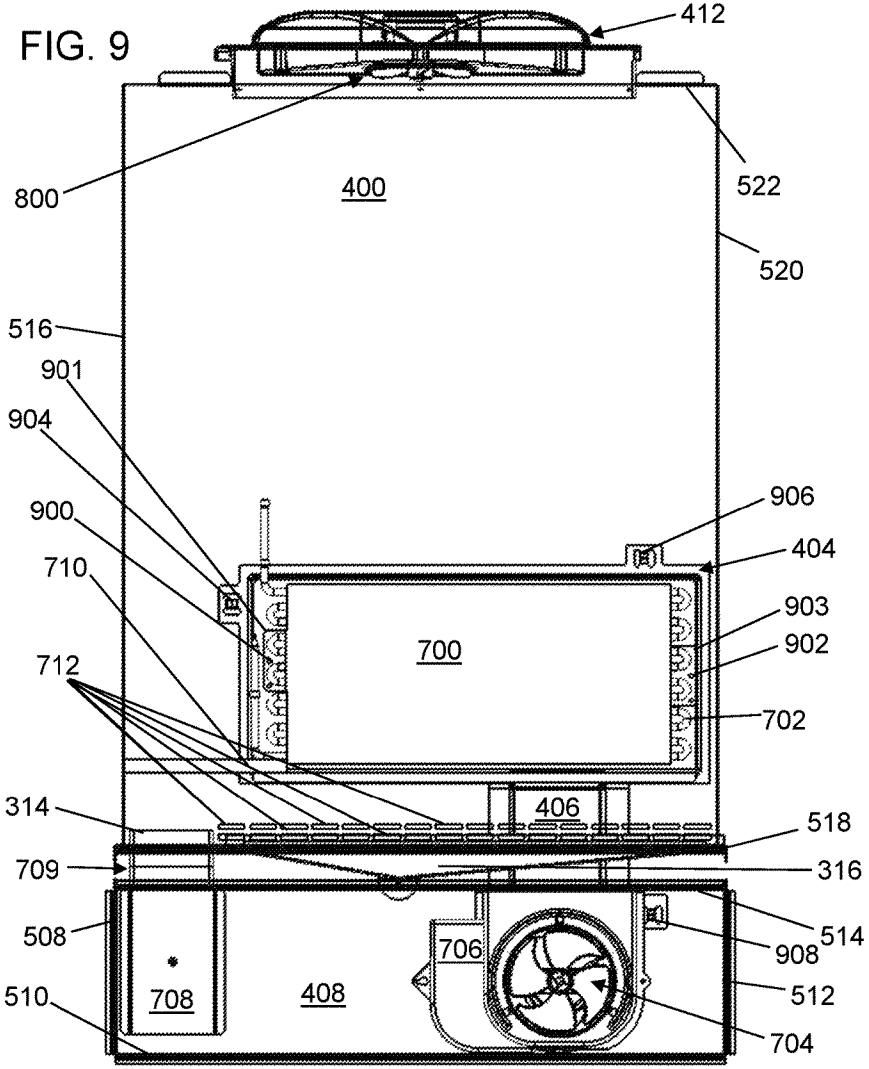
FIG. 9 depicts a front view of the second portion of FIG. 8 in accordance with an illustrative embodiment.
Figure 8:
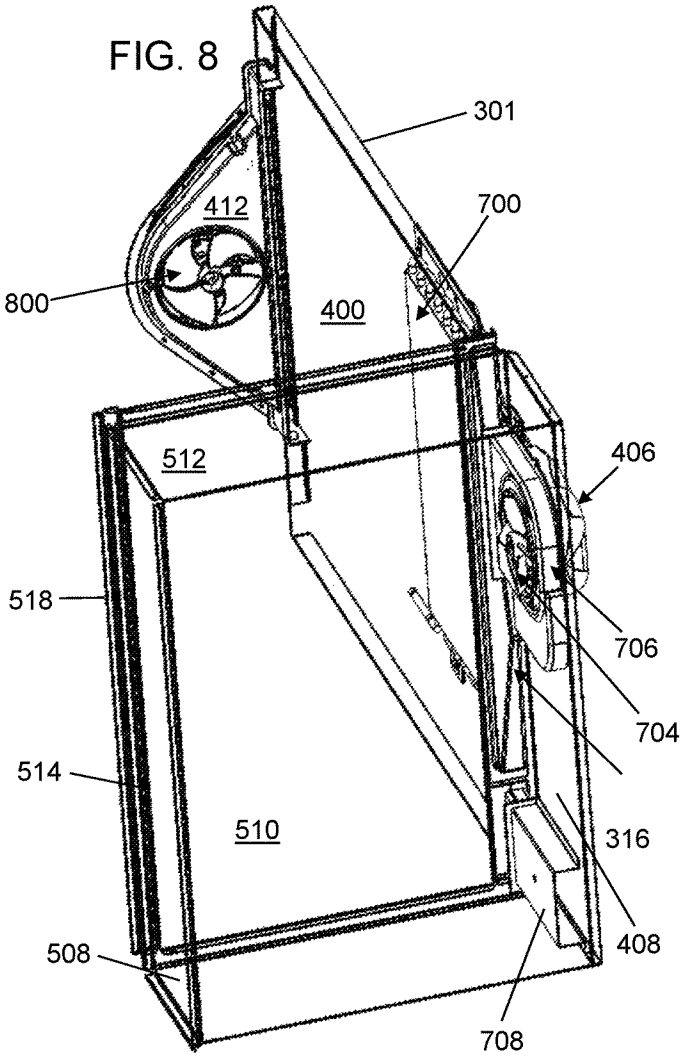
FIG. 8 depicts a right, bottom perspective view of a second portion of the refrigerator of FIG. 1 in accordance with an illustrative embodiment.
Figure 11:
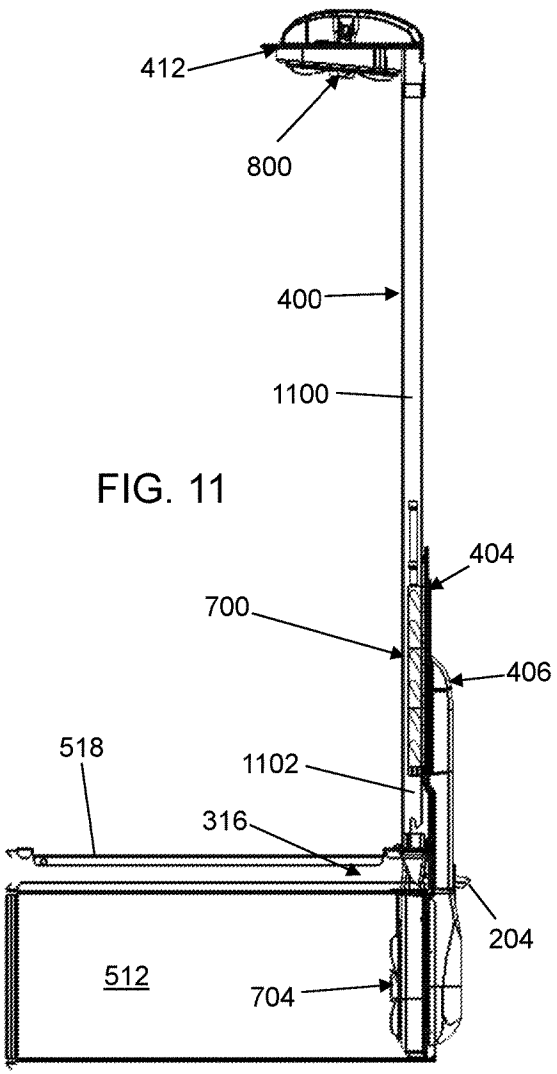
FIG. 11 depicts a right-side view of the second portion of FIG. 8 in accordance with an illustrative embodiment.
Figure 10:
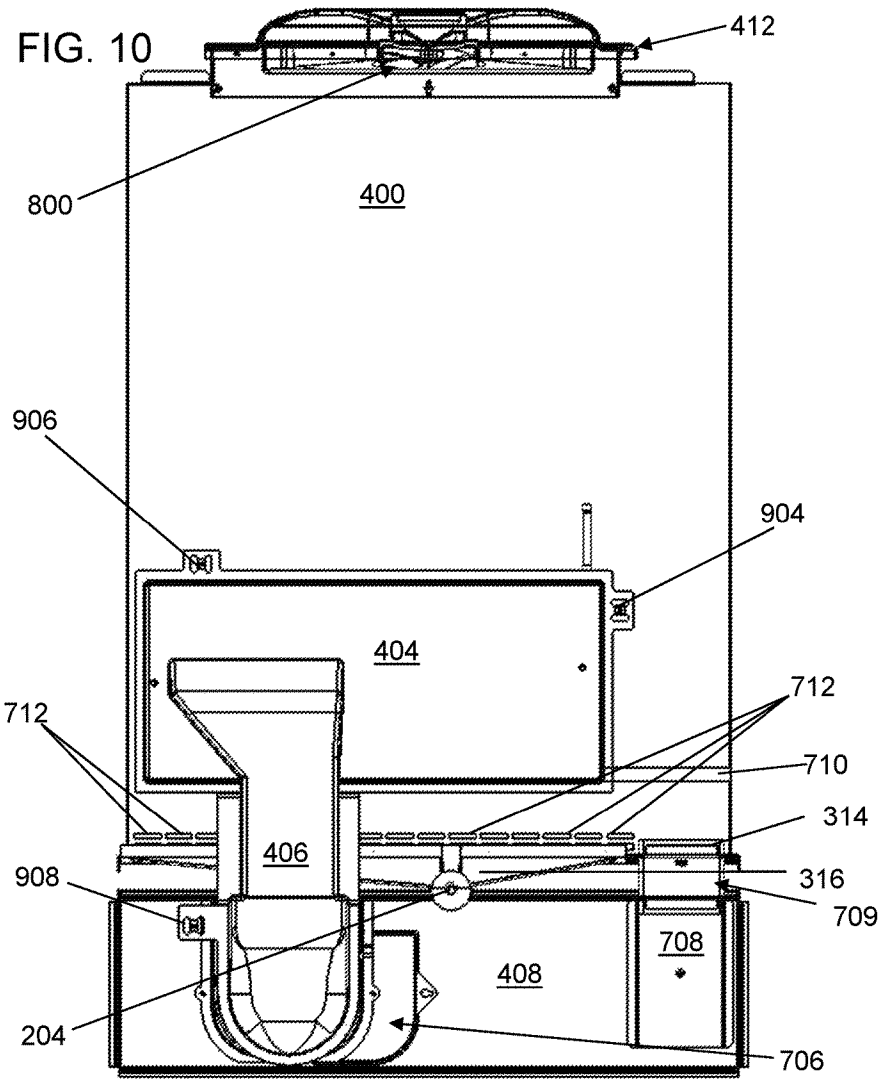
FIG. 10 depicts a back view of the second portion of FIG. 8 in accordance with an illustrative embodiment.

With reference to FIG. 7, a left perspective view of interior components related to circulating cooled air to second compartment 104 are shown in accordance with an illustrative embodiment. With reference to FIG. 8, a bottom perspective view of interior components related to circulating cooled air to second compartment 104 and to third compartment 106 are shown in accordance with an illustrative embodiment. With reference to FIG. 9, a front view of interior components related to circulating cooled air to second compartment 104 and to third compartment 106 are shown in accordance with an illustrative embodiment. With reference to FIG. 10, a back view of interior components related to circulating cooled air to second compartment 104 and to third compartment 106 are shown in accordance with an illustrative embodiment. With reference to FIG. 11, a right-side view of interior components related to circulating cooled air to second compartment 104 and to third compartment 106 are shown in accordance with an illustrative embodiment. Second compartment left-side plate 508, second compartment bottom plate 510, second compartment right-side plate 512, second compartment top plate 514, second compartment back plate 408, third compartment left-side plate 516, third compartment bottom plate 518, third compartment right-side plate 520, third compartment top plate 522, and third compartment back plate 400 are either transparent or removed in FIGS. 7 to 11 to better illustrate the components.

In the illustrative embodiment, second compartment 104 and third compartment 106 are cooled by a second refrigeration system that includes a second evaporator 700, a second compressor (not shown), etc. Second evaporator 700 is mounted to evaporator mounting plate 404 between middle plate 301 and third compartment back plate 400. In the illustrative embodiment, air flows upward through second evaporator 700 and is cooled by refrigerant that flows through a second evaporator coil 702 of second evaporator 700. In the illustrative embodiment, evaporator mounting plate 404 is mounted to middle plate 301.

The refrigerant is circulated through second evaporator coil 702 of second evaporator 700, a second compressor (not shown), a second condenser, an expansion valve, etc. to cool second compartment 104 and third compartment 106. The second refrigeration system is separate from the first refrigeration system.

Second compartment air duct 406 may be mounted between second evaporator 700 and the second enclosed space of second compartment 104. Second compartment air duct 406 may be mounted to middle plate 301, third compartment back plate 400, and/or evaporator mounting plate 404 at a first end and to second compartment back plate 408 at a second end. Air flows from an inlet side of second evaporator 700 that is below second evaporator 700 to an outlet side of second evaporator 700 that is above second evaporator 700 through operation of a third fan 800 (shown referring to FIG. 8). The space between middle plate 301 and third compartment back plate 400 that is above second evaporator 700 defines a third compartment air duct 1100 (shown referring to FIG. 11). The space between middle plate 301 and third compartment back plate 400 that is below second evaporator 700 defines a third compartment return duct 1102 (shown referring to FIG. 11). In the illustrative embodiment, third compartment air duct 1100 and third compartment return duct 1102 form a continuous duct within which second evaporator 700 is mounted. Third fan 800 is mounted within a third fan housing 412 mounted to or within top wall 114 though third fan housing 412 may be mounted to a different wall of refrigerator body 300 and/or within third compartment air duct 1100 in alternative embodiments.

A second air circulation system for the second enclosed space may include second compartment air duct 406, a second fan 704, a second compartment return duct wall 708, a second compartment return duct wall 314, an air flow diverter wall 710, and third compartment return duct 1102. Second compartment return duct wall 708 and second compartment return duct wall 314 define a second compartment return duct 709. Second compartment return duct wall 708 forms a first aperture and a second aperture. Second compartment return duct wall 314 forms a third aperture and a fourth aperture. The first aperture of second compartment return duct wall 708 is located in the second enclosed space as shown referring to FIG. 8. The fourth aperture of second compartment return duct wall 314 is located in third compartment return duct 1102 between middle plate 301 and third compartment back plate 400 below second evaporator 700. The second aperture of second compartment return duct wall 708 is mounted to the third aperture of second compartment return duct wall 314 to form second compartment return duct 709. Of course, second compartment return duct 709 may be formed of a fewer or a greater number of duct walls having various shapes and sizes sufficient to circulate a desired amount of air from the second enclosed space towards second evaporator 700 from the second enclosed space.

Air flow diverter wall 710 is mounted between middle plate 301 and third compartment back plate 400 and above the fourth aperture of second compartment return duct wall 314 to receive and redirect air from second compartment return duct 709 towards the inlet side of second evaporator 700. In the illustrative embodiment, air flow diverter wall 710 extends between a left-side of second evaporator 700 and a left-side plate 711 of third compartment back plate 400 to block and redirect all of the air from second compartment return duct 709.

In the illustrative embodiment, second compartment return duct 709 is positioned adjacent second compartment back plate 408. Second fan 704 is mounted within a second fan housing 706 mounted to or within second compartment air duct 406 and/or second compartment back plate 408. The first aperture of second compartment return duct wall 708 is located at an opposite end of second compartment back plate 408 relative to second fan 704. Second fan 704 may be selected based on a direction of desired air flow into the second enclosed space and a size of the second enclosed space. For example, second fan 704 may be an axial flow fan such as that shown in the illustrative embodiment, a centrifugal fan, a cross-flow fan, etc. A motor (not shown) for second fan 704 may also be mounted within second fan housing 706. Second fan 704 may be mounted to a different wall of refrigerator body 300 in alternative embodiments.

Second temperature sensor 3116 may be mounted in the second enclosed space to measure a first temperature of the air in the second enclosed space and to send the measured first temperature to refrigerator controller 3100. For illustration, second temperature sensor 3116 may be a thermistor electrically connected either by wire or wirelessly to refrigerator controller 3100. In an illustrative embodiment, second temperature sensor 3116 may be mounted within or adjacent the second enclosed space generally opposite second fan 704.

A third air circulation system for the third enclosed space may include third compartment air duct 1100, third fan 800, third compartment return duct 1102, and a plurality of vent aperture walls 712 that define a plurality of vents formed through third compartment back plate 400. The plurality of vents is positioned between the third enclosed space and third compartment return duct 1102. The plurality of vents is located at an opposite end of third compartment back plate 400 relative to third fan 800. Third fan 800 may be selected based on a direction of desired air flow into the third enclosed space and a size of the third enclosed space. For example, third fan 800 may be an axial flow fan such as that shown in the illustrative embodiment, a centrifugal fan, a cross-flow fan, etc. A motor (not shown) for third fan 800 may also be mounted within third fan housing 412.

An evaporator condensation tray 316 is mounted below second evaporator 700 to catch any liquid and route it to an exterior of refrigerator body 300 through an drain port 204.

Third temperature sensor 3120 may be mounted in the third enclosed space to measure a second temperature of the air in the third enclosed space and to send the measured second temperature to refrigerator controller 3100. For illustration, third temperature sensor 3120 may be a thermistor electrically connected either by wire or wirelessly to refrigerator controller 3100. In an illustrative embodiment, third temperature sensor 3120 may be mounted within or adjacent the third enclosed space in a location chosen for optimal control of the temperature.

The position and orientation of various components of the second refrigeration system, the second air circulation system, and the third air circulation system may be moved and/or reoriented based on the arrangement of second compartment 104 and third compartment 106 relative to each other. Additionally, various components of the second refrigeration system, the second air circulation system, and the third air circulation system may be mounted in a different wall of refrigerator 300 or mounted in different walls instead of mounted in the same wall. For example, second evaporator 700 may be positioned adjacent second compartment 104 instead of third compartment 106 or between second compartment 104 and third compartment 106. Second evaporator 700 further may be mounted in left-side wall 302 or right-side wall 116 instead of back wall 200.

Figure 13:
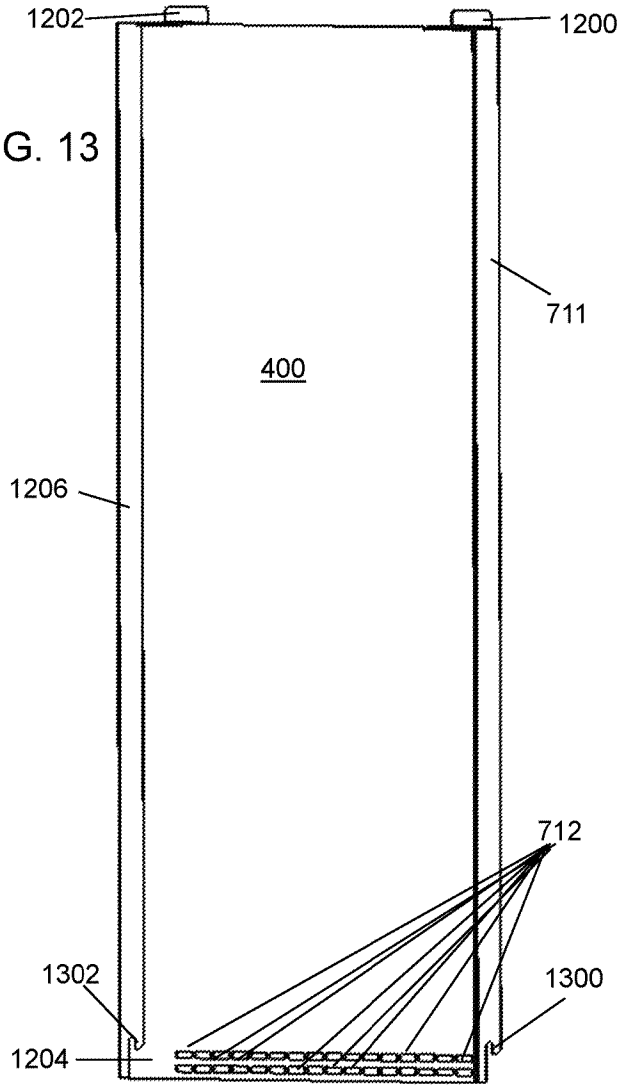
FIG. 13 depicts a right, back perspective view of the third compartment back plate of the refrigerator of FIG. 1 in accordance with an illustrative embodiment.
Figure 12:
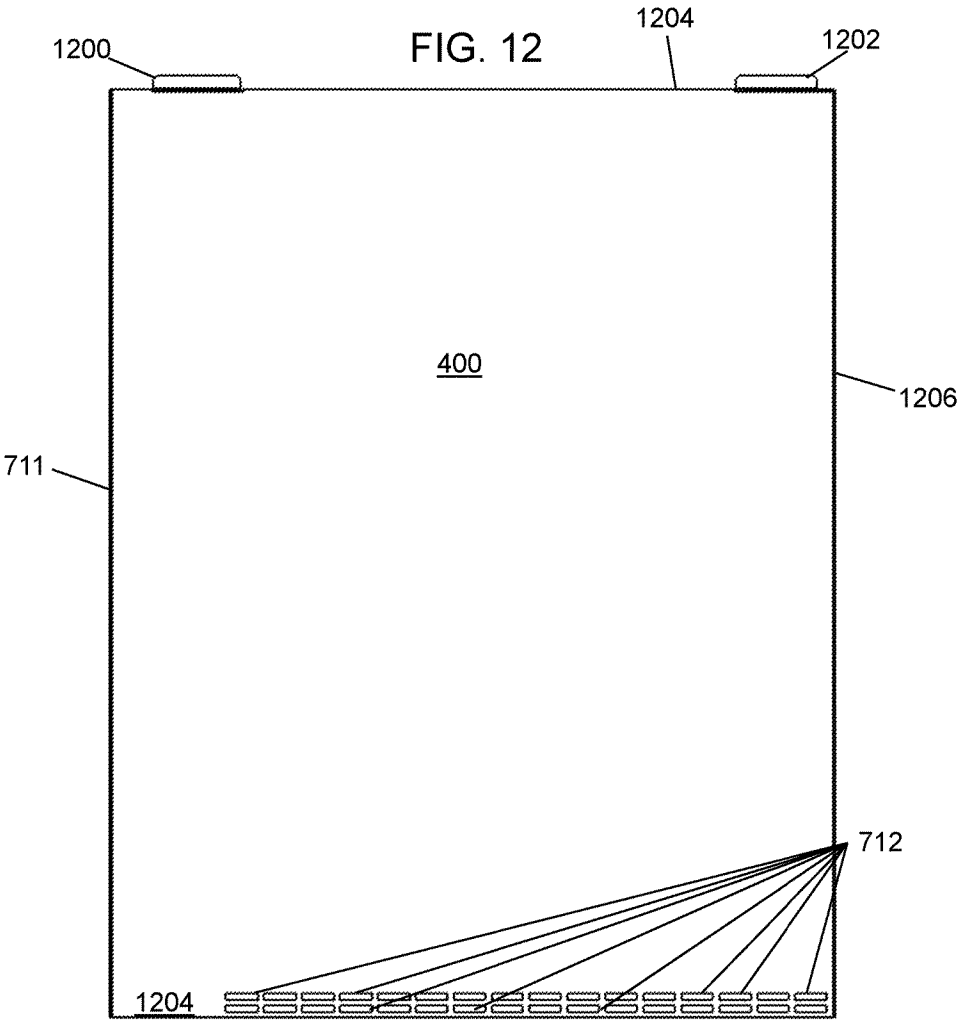
FIG. 12 depicts a front view of a third compartment back plate of the refrigerator of FIG. 1 in accordance with an illustrative embodiment.

Referring to FIG. 12, a front view of third compartment back plate 400 is shown in accordance with an illustrative embodiment. Referring to FIG. 13, a right-side, back perspective view of third compartment back plate 400 is shown in accordance with an illustrative embodiment. In the illustrative embodiment, the plurality of vent aperture walls 712 are arranged in two rows adjacent a bottom of third compartment back plate 400. In alternative embodiments, the plurality of vent aperture walls 712 may have other shapes and sizes and may be arranged in a fewer or a greater number of rows and columns. A left tab 1200, a right tab 1202, a left hook 1300, and a right hook 1302 are used to mount third compartment back plate 400 to middle plate 301 though other mounting methods and fasteners may be used in alternative embodiments. Left tab 1200 and right tab 1202 extend upward from a top edge 1204 of third compartment back plate 400. Left hook 1300 is formed at a bottom end of left-side plate 711. Right hook 1302 is formed at a bottom end of a right-side plate 1206. The plurality of vent aperture walls 712 do not extend into an area 1204 located in front of second compartment return duct wall 314.

Figure 14:
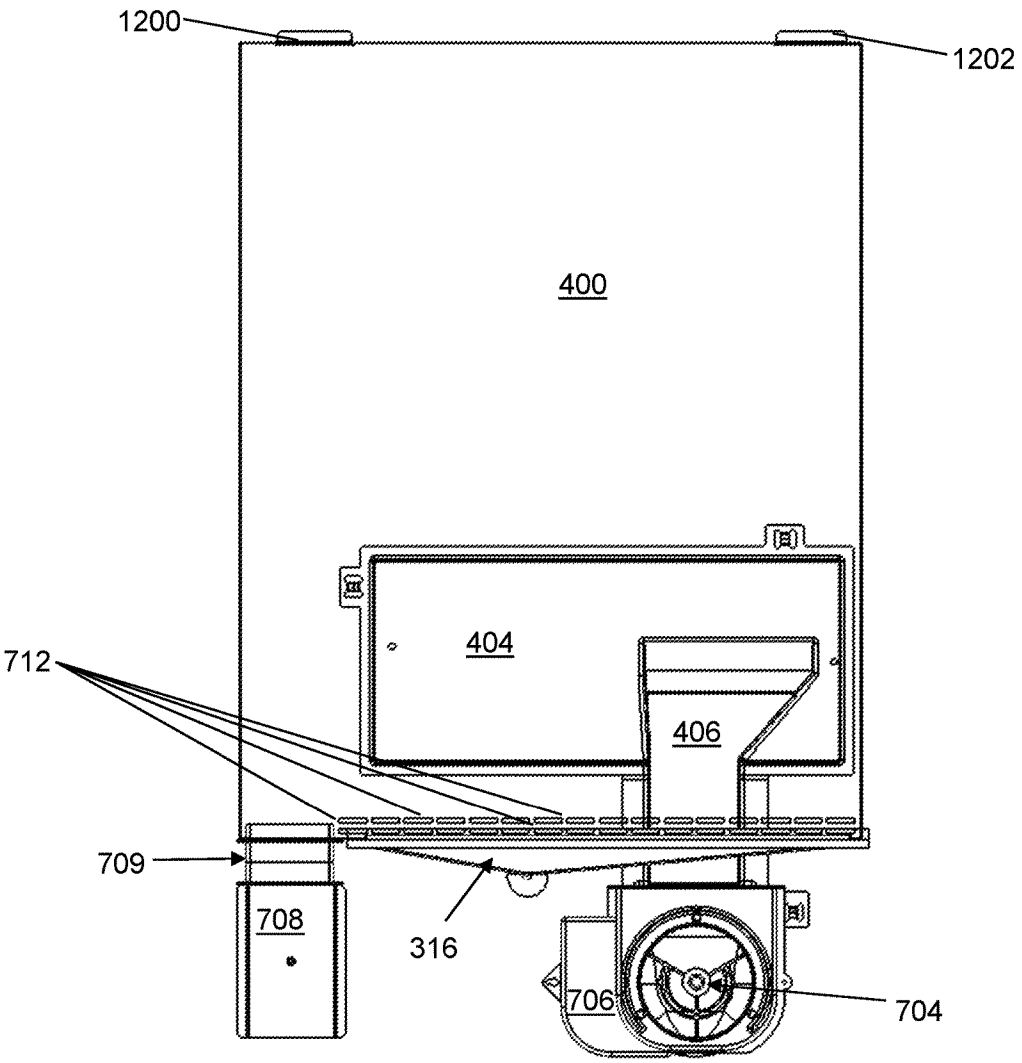
FIG. 14 depicts a front view of a third portion of the refrigerator of FIG. 1 in accordance with an illustrative embodiment.
Figure 15:
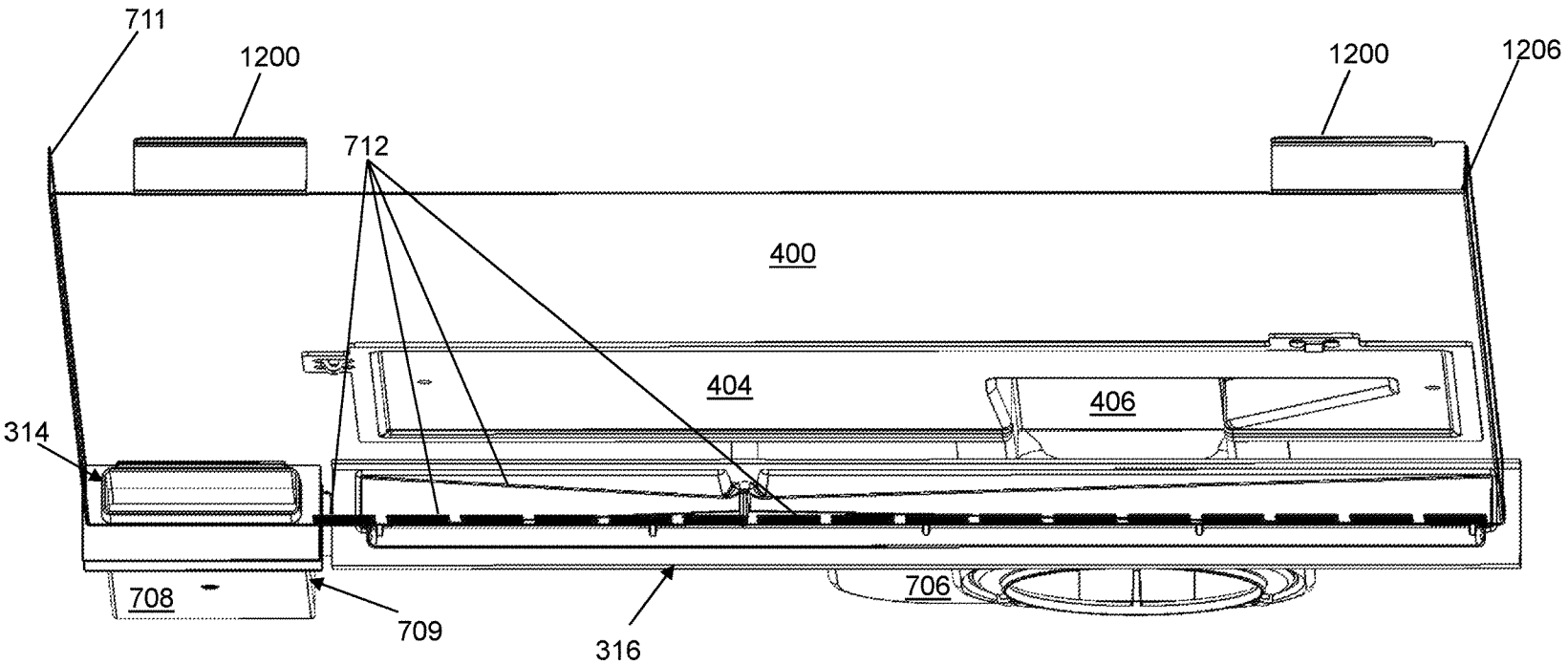
FIG. 15 depicts a top, front perspective view of the third portion of FIG. 14 in accordance with an illustrative embodiment.
Figure 16:
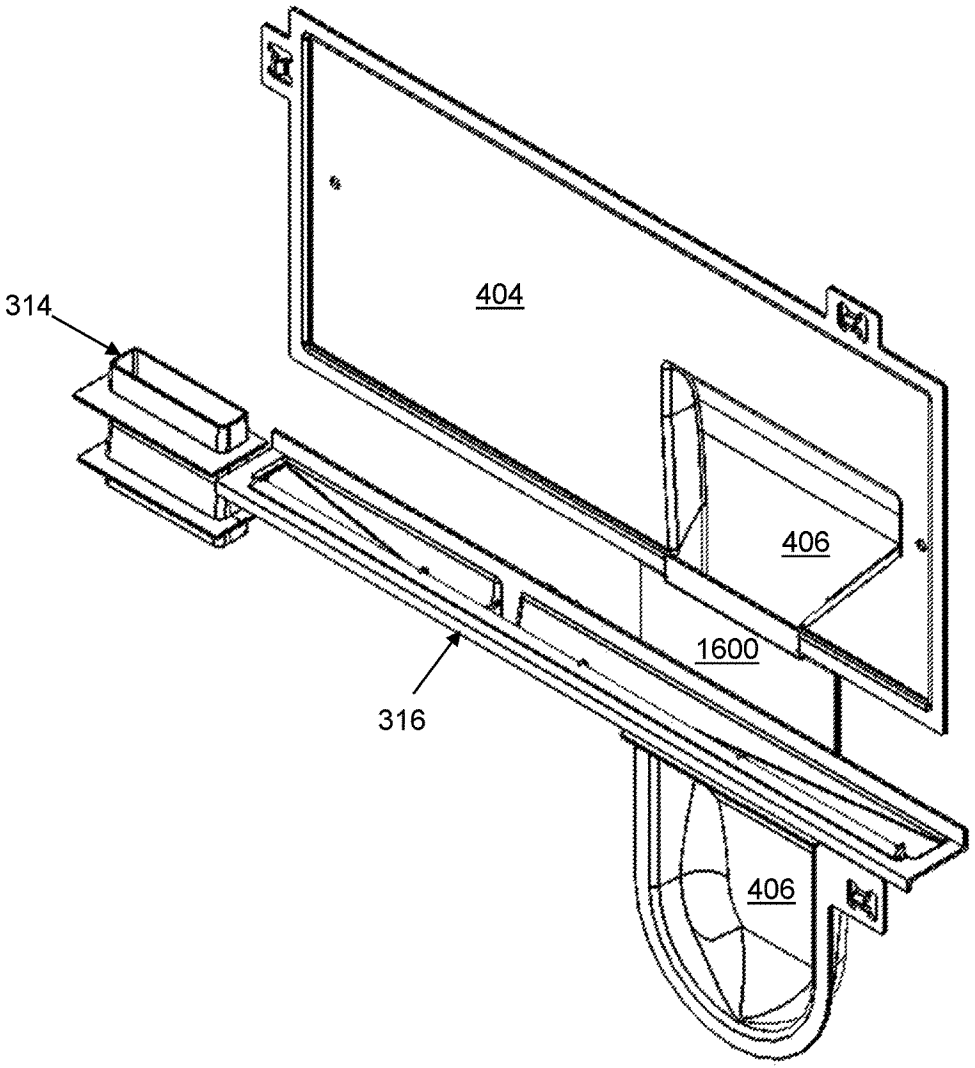
FIG. 16 depicts a top, front perspective view of a fourth portion of the refrigerator of FIG. 1 in accordance with an illustrative embodiment.
Figure 18:
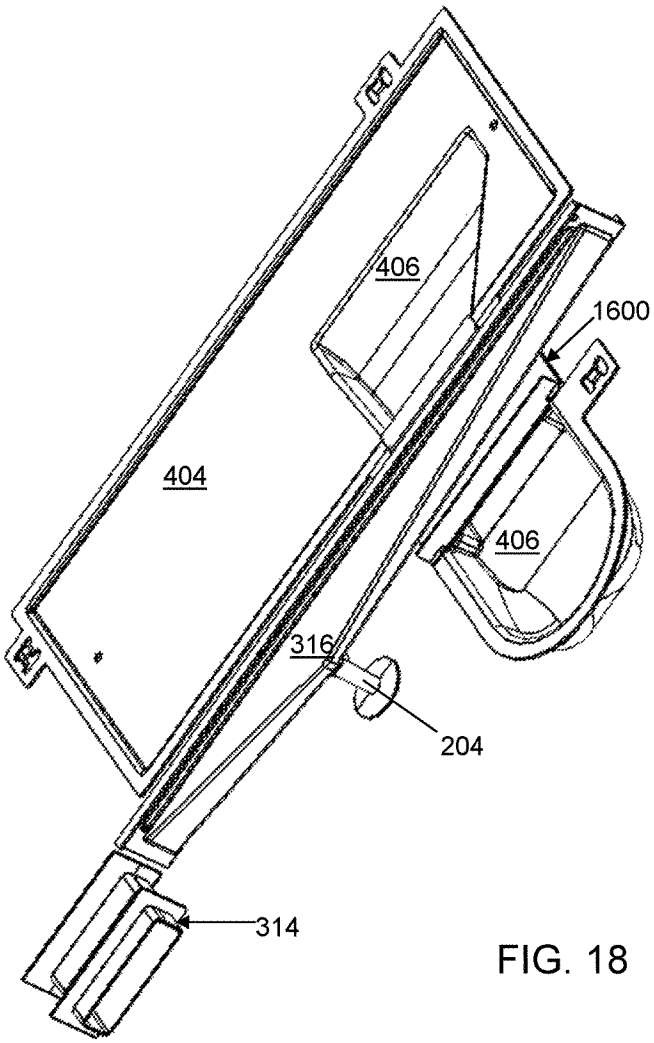
FIG. 18 depicts a bottom, front perspective view of the fourth portion of FIG. 16 in accordance with an illustrative embodiment.
Figure 17:
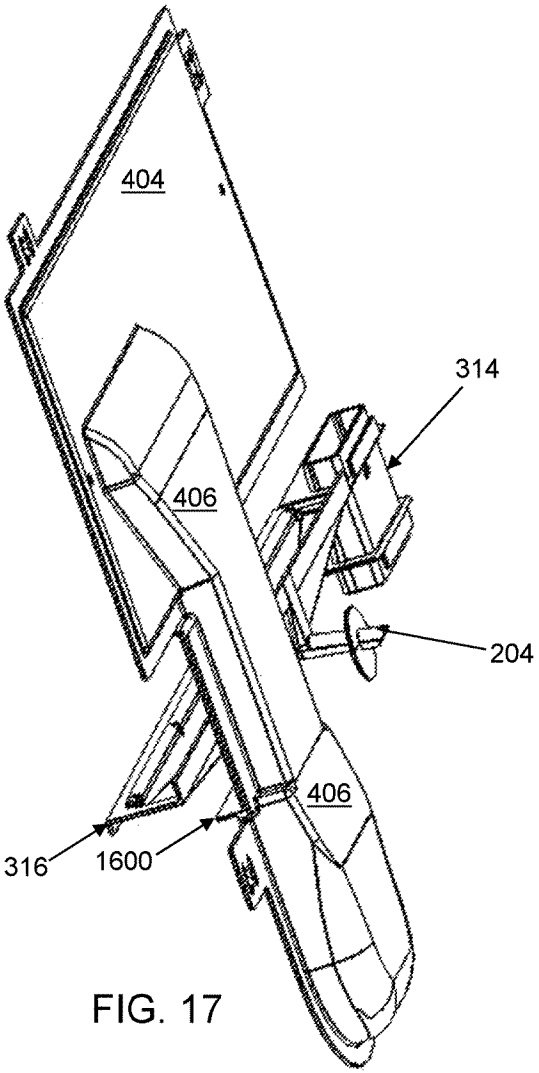
FIG. 17 depicts a top, back perspective view of the fourth portion of FIG. 16 in accordance with an illustrative embodiment.
Figure 20:
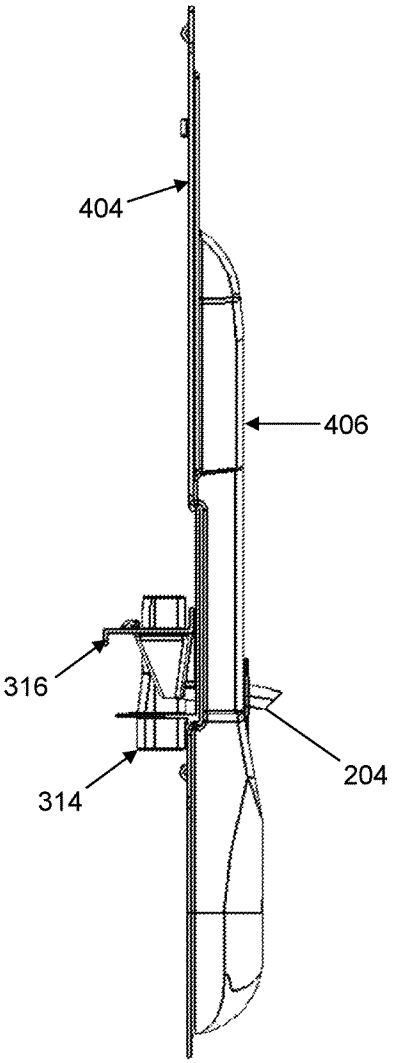
FIG. 20 depicts a right-side view of the fourth portion of FIG. 16 in accordance with an illustrative embodiment.
Figure 19:
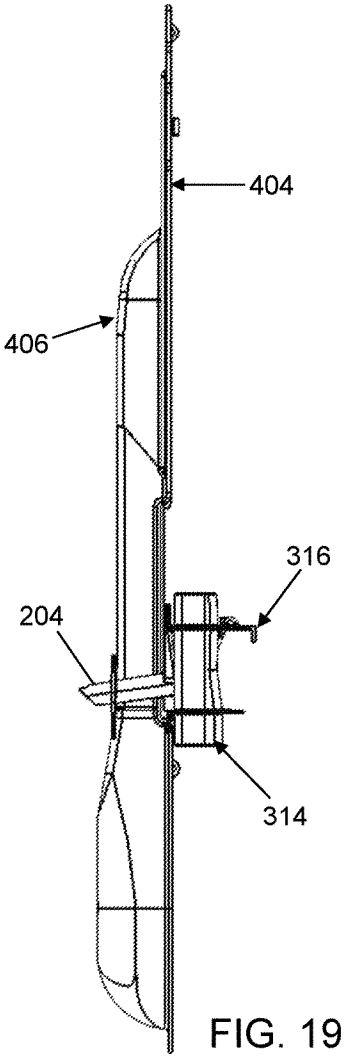
FIG. 19 depicts a left-side view of the fourth portion of FIG. 16 in accordance with an illustrative embodiment.
Figure 21:
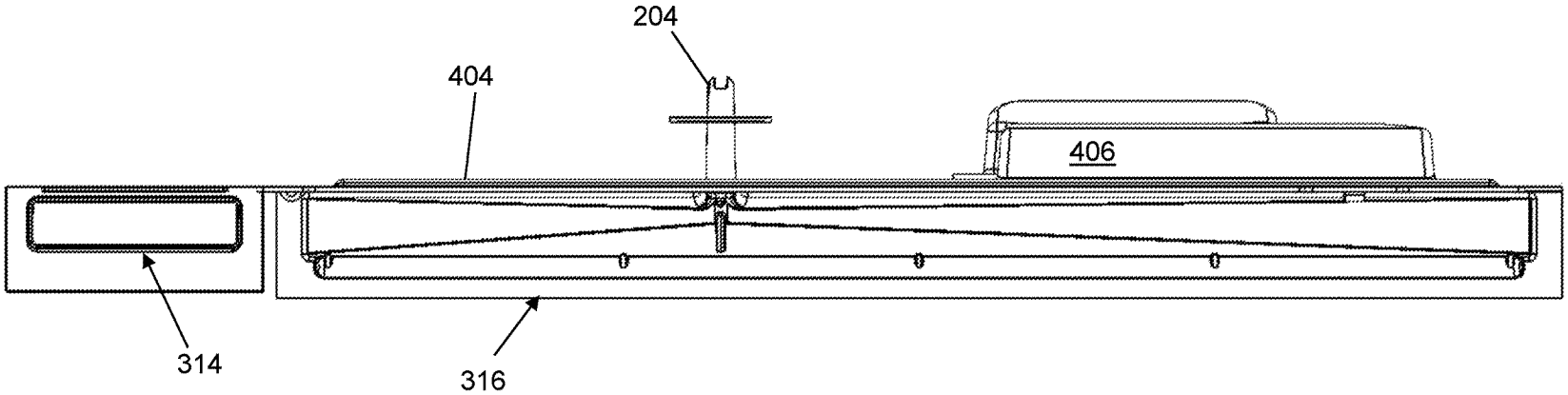
FIG. 21 depicts a top view of the fourth portion of FIG. 16 in accordance with an illustrative embodiment.

Referring to FIG. 14, a front view of components of the second air circulation system and the third air circulation system are shown in accordance with an illustrative embodiment. Referring to FIG. 15, a top, front perspective view of components of the second air circulation system and the third air circulation system are shown in accordance with an illustrative embodiment. Referring to FIG. 16, a top, front perspective view of components of the second air circulation system are shown in accordance with an illustrative embodiment. Referring to FIG. 17, a right-side, back perspective view of components of the second air circulation system are shown in accordance with an illustrative embodiment. Referring to FIG. 18, a bottom, front perspective view of components of the second air circulation system are shown in accordance with an illustrative embodiment. Referring to FIG. 19, a left-side view of components of the second air circulation system are shown in accordance with an illustrative embodiment. Referring to FIG. 20, a right-side view of components of the second air circulation system are shown in accordance with an illustrative embodiment. Referring to FIG. 21, a top view of components of the second air circulation system are shown in accordance with an illustrative embodiment.

Drain port 204 and second compartment air duct 406 protrude outward toward back plate 202.

Figure 22:
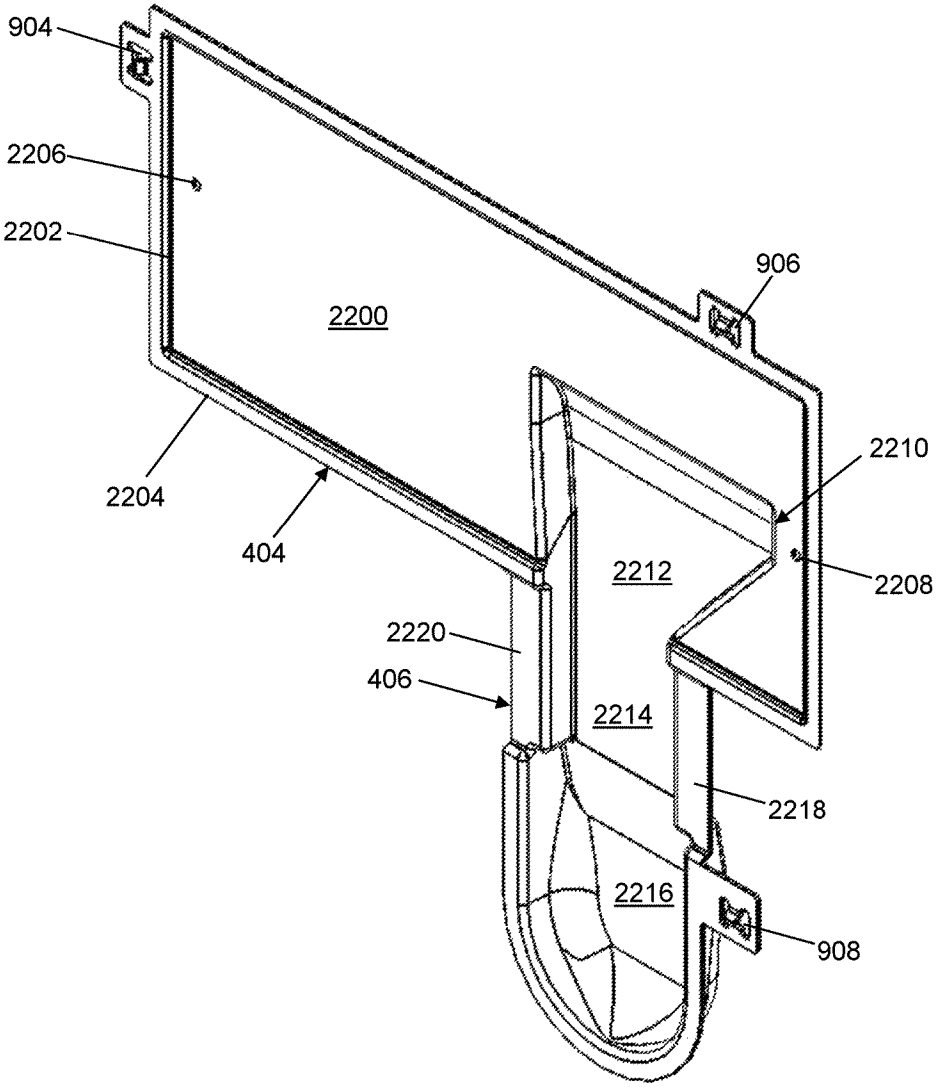
FIG. 22 depicts a right, front perspective view of a second compartment duct wall of the refrigerator of FIG. 1 in accordance with an illustrative embodiment.
Figure 23:
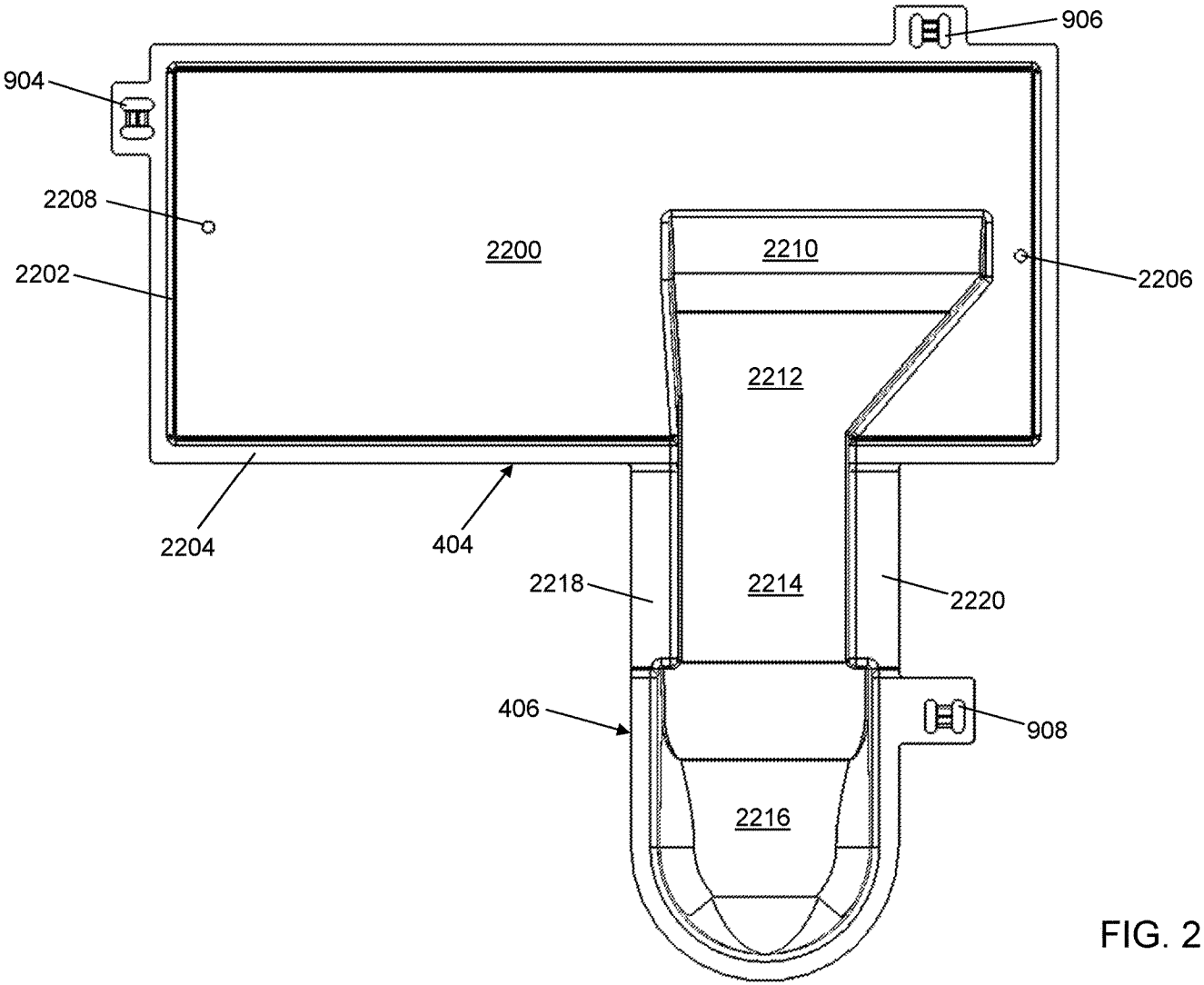
FIG. 23 depicts a back view of the second compartment duct wall of FIG. 22 in accordance with an illustrative embodiment.
Figure 24:
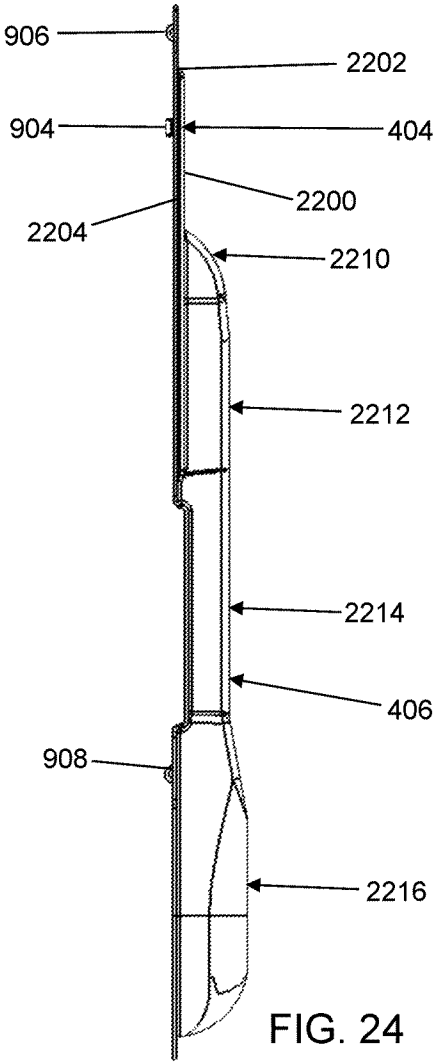
FIG. 24 depicts a right-side view of the second compartment duct wall of FIG. 22 in accordance with an illustrative embodiment.

Referring to FIG. 22, a front perspective view of evaporator mounting plate 404 and second compartment air duct 406 are shown in accordance with an illustrative embodiment. Referring to FIG. 23, a back view of evaporator mounting plate 404 and second compartment air duct 406 are shown in accordance with an illustrative embodiment. Referring to FIG. 24, a right-side view of evaporator mounting plate 404 and second compartment air duct 406 are shown in accordance with an illustrative embodiment.

For illustration, second compartment air duct 406 and evaporator mounting plate 404 may be a single continuous piece of material, for example, by molding, or may be formed of multiple distinct pieces mounted together, for example, attached to each other using various fasteners including adhesives, screws, rivets, welding, etc. Evaporator mounting plate 404 may be mounted to middle plate 301 using double sided tape and a first locator 904 and a second locator 906. Second compartment air duct 406 may be mounted to second compartment back plate 408 using a third locator 908. First locator 904, second locator 906, and third locator 908 facilitate a proper positioning of evaporator mounting plate 404 and of second compartment air duct 406 relative to middle plate 301 and to second compartment back plate 408, respectively.

Evaporator mounting plate 404 may include a flat plate 2200, a raised edge 2202, a ledge 2204, a first fastener aperture wall 2206, and a second fastener aperture wall 2208. First fastener aperture wall 2206 and second fastener aperture wall 2208 are formed through flat plate 2200.

Second compartment air duct 406 may include an entry portion 2210, a funnel portion 2212, a channel portion 2214, a bowl portion 2216, a right-side wing plate 2218, and a left-side wing plate 2220. Entry portion 2210 is defined by walls that form a rectangular aperture with a curved back wall. Funnel portion 2212 is below entry portion 2210 and is defined by walls that form a rectangular channel with a sloped wall on one side that decreases a channel width from a width of entry portion 2210 to a width of channel portion 2214. Channel portion 2214 is below funnel portion 2212 and is defined by walls that form a rectangular channel between funnel portion 2212 and bowl portion 2216. Bowl portion 2216 is below channel portion 2214 and is defined by walls that transition from the channel formed by channel portion 2214 to sloped and curved walls that form a generally concave bowl. The concave bowl may be sized and shaped (curved) based on second fan 704 to assist in directing air from second evaporator 700 toward second fan 704. Right-side wing plate 2218 and left-side wing plate 2220 extends in a generally perpendicular direction from opposite walls of channel portion 2214 between funnel portion 2212 and bowl portion 2216.

Raised edge 2202 extends in a generally perpendicular direction from a periphery of flat plate 2200 except where entry portion 2210 and funnel portion 2212 form apertures in flat plate 2200. Ledge 2204 extends outward in a generally perpendicular direction from a periphery of raised edge 2202.

Figure 25:
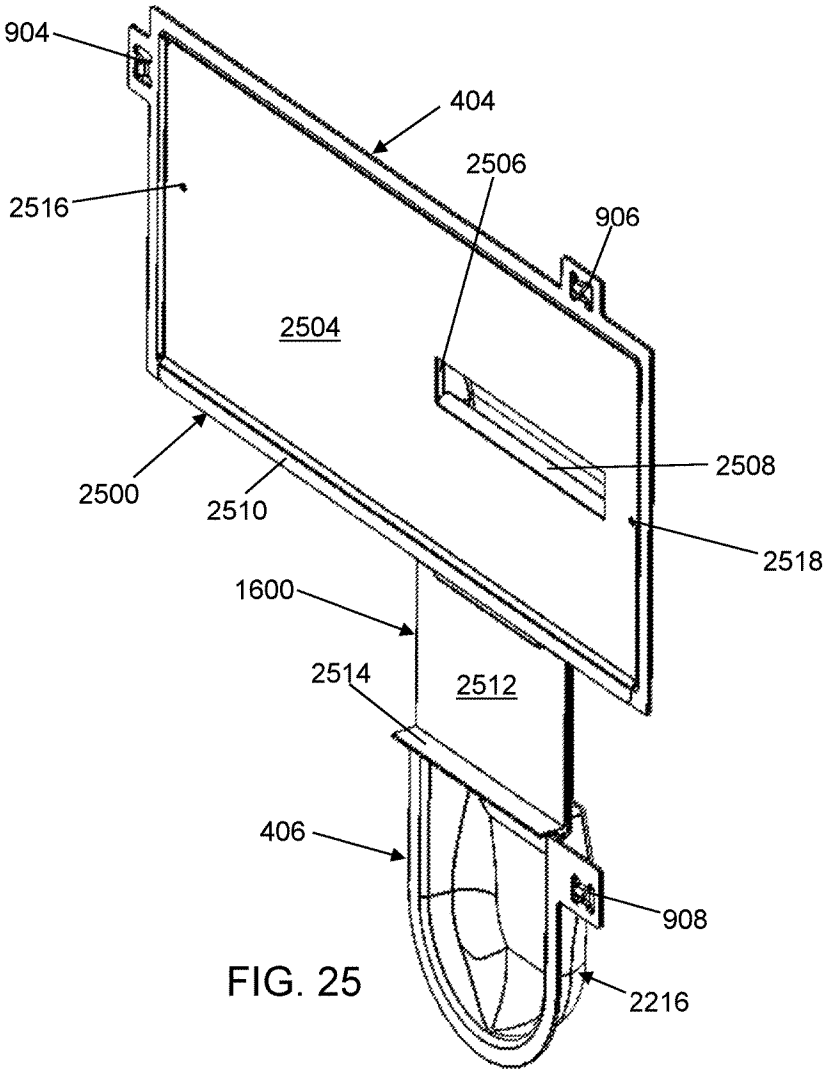
FIG. 25 depicts a right, front perspective view of the second compartment duct wall of FIG. 22 covered by plates to direct air flow in accordance with an illustrative embodiment.
Figure 26:
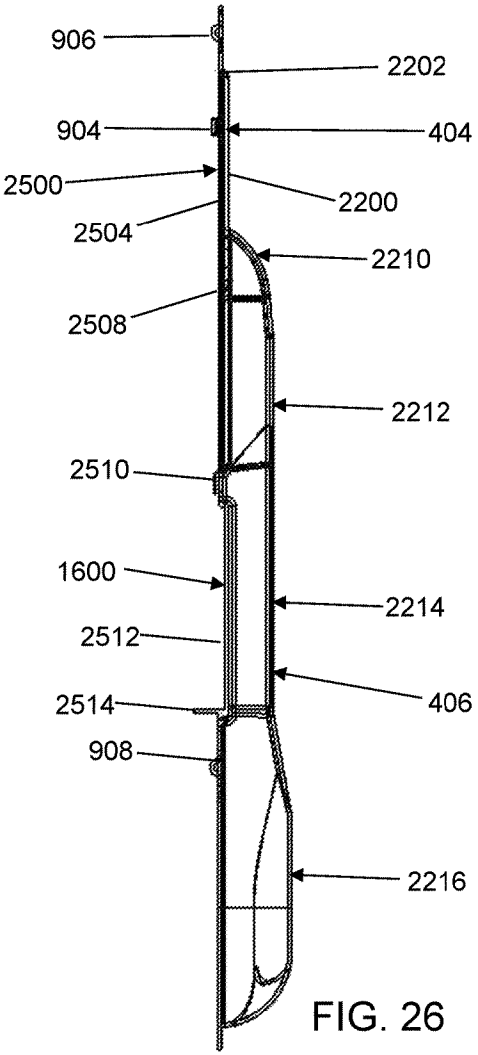
FIG. 26 depicts a right-side view of the second compartment duct wall of FIG. 25 in accordance with an illustrative embodiment.

Referring to FIG. 25, a front perspective view of evaporator mounting plate 404 and second compartment air duct 406 are shown in accordance with an illustrative embodiment. Referring to FIG. 26, a right-side view of evaporator mounting plate 404 and second compartment air duct 406 are shown in accordance with an illustrative embodiment.

Figure 30:
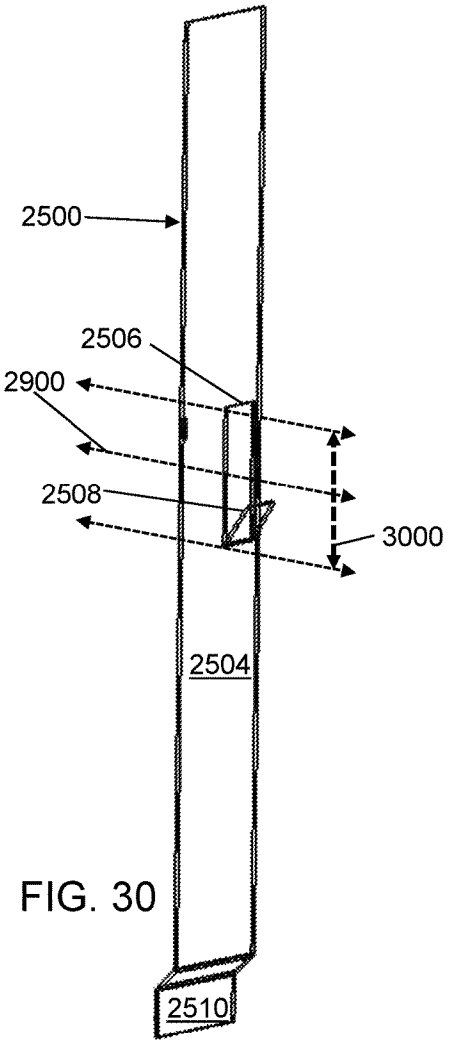
FIG. 30 depicts a right, back perspective view of a second compartment duct plate of the refrigerator of FIG. 1 in accordance with an illustrative embodiment.

A first duct plate 2500 and a second duct plate 1600 (reference first shown referring to FIG. 16) are mounted to cover portions of second compartment air duct 406 to control air flow from second evaporator 700 to second fan 704. Referring to FIG. 30, right, back perspective view of first duct plate 2500 that is transparent is shown in accordance with an illustrative embodiment.

First duct plate 2500 may include a first duct plate wall 2504, a plate aperture wall 2506, an aperture drip plate 2508, a duct plate mounting tab 2510, a third fastener aperture wall 2516, and a fourth fastener aperture wall 2518. Third fastener aperture wall 2516 and fourth fastener aperture wall 2518 are formed through first duct plate wall 2504. In FIG. 26, second compartment air duct 406 is transparent to show a relative location of aperture drip plate 2508 when first duct plate 2500 is mounted to second compartment air duct 406. First duct plate wall 2504 is sized and shaped to fit within raised edge 2202 of evaporator mounting plate 404. Duct plate mounting tab 2510 is sized and shaped to abut raised edge 2202 and ledge 2204 along a bottom edge of evaporator mounting plate 404. Duct plate mounting tab 2510 provides a drip edge to keep water droplets from pooling in a bottom edge of third compartment back plate 400 and evaporator mounting plate 404 and entering a cabinet foam mounted between third compartment back plate 400 and exterior plate 202. Plate aperture wall 2506 defines a rectangular aperture that aligns with the aperture formed by entry portion 2210 when first duct plate 2500 is mounted to evaporator mounting plate 404. Aperture drip plate 2508 is sloped upward from a bottom edge of plate aperture wall 2506 as discussed further below.

Figure 28:
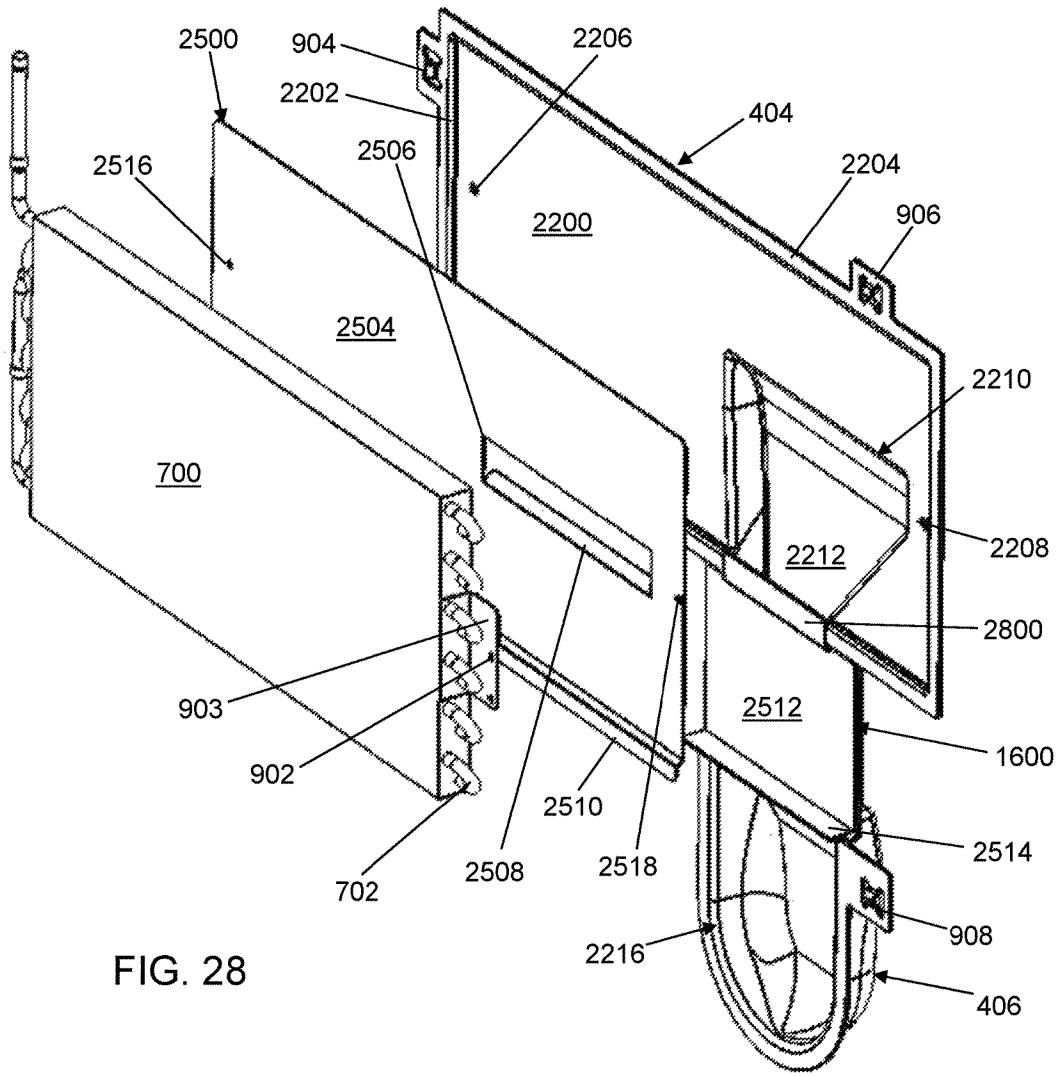
FIG. 28 depicts an exploded, right, front perspective view of the second compartment duct wall of FIG. 27 in accordance with an illustrative embodiment.

Second duct plate 1600 may include a second duct plate wall 2512, a plate ledge 2514, and a second duct plate mounting tab 2800 (shown referring to FIG. 28). Plate ledge 2514 extends outward in a generally perpendicular direction from a bottom edge of second duct plate wall 2512 to cover a transition area between fan housing 706 and second compartment air duct 406. Second duct plate mounting tab 2800 is sized and shaped to cover a transition region between funnel portion 2212 and channel portion 2214 approximately where raised edge 2202 and ledge 2204 do not extend around a periphery of flat plate 2200.

Plate aperture wall 2506 provides an opening in first duct plate wall 2504 for air from second evaporator 700 to be received into second compartment air duct 406 when second fan 704 is on, but otherwise blocks a flow of air from second evaporator 700 to second compartment air duct 406. Second duct plate wall 2512 and second duct plate mounting tab 2800 fit over channel portion 2214 to form an enclosure that keeps air from escaping second compartment air duct 406 before it reaches second fan 704.

Figure 27:
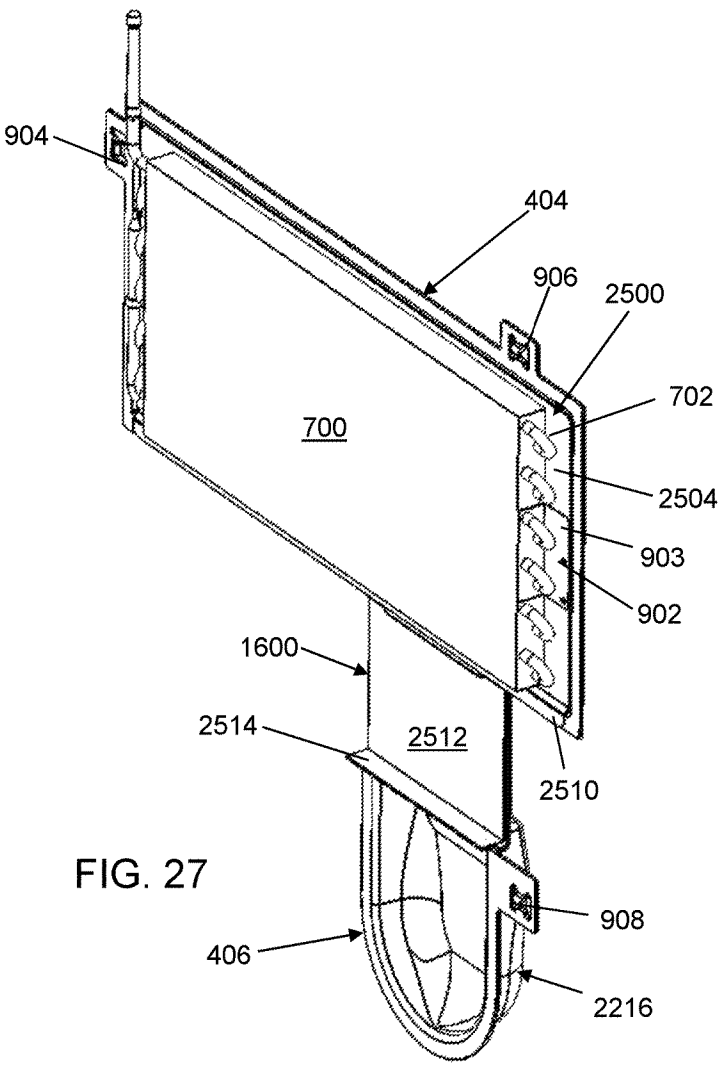
FIG. 27 depicts a right, front perspective view of the second compartment duct wall of FIG. 22 covered by plates and an evaporator in accordance with an illustrative embodiment.
Figure 29:
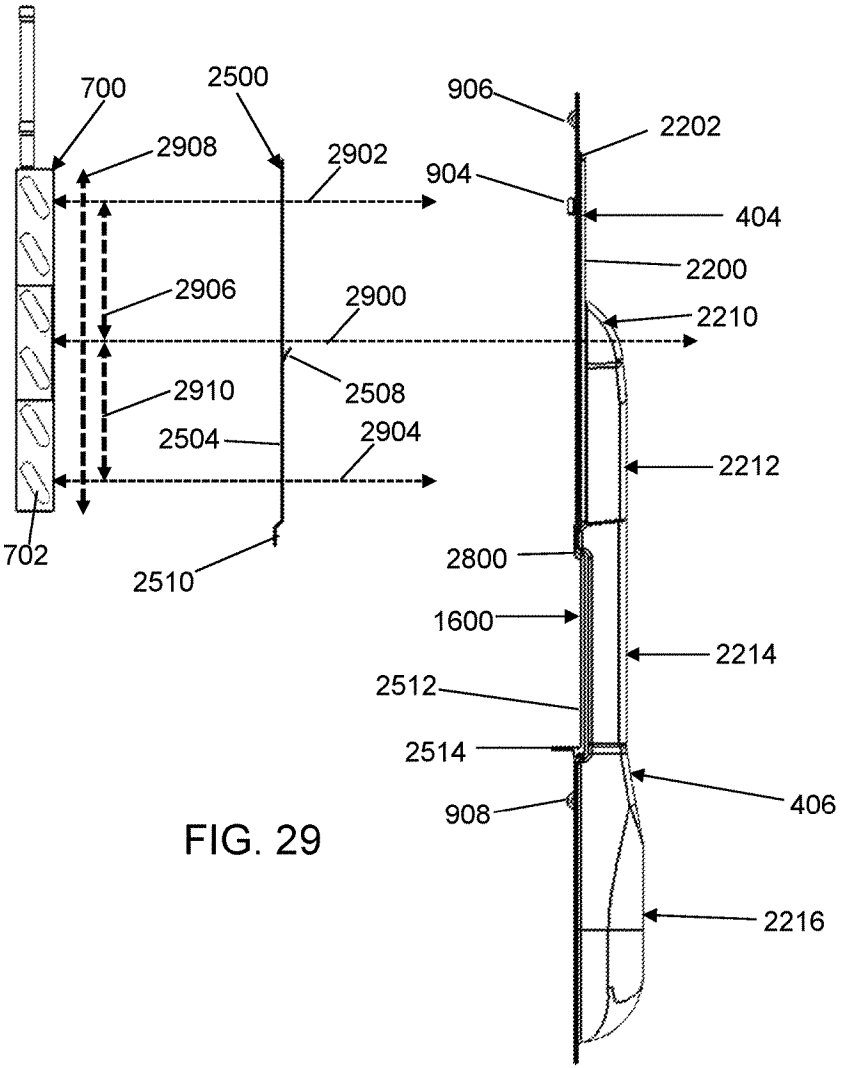
FIG. 29 depicts an exploded, right-side view of the second compartment duct wall of FIG. 27 in accordance with an illustrative embodiment.

Referring to FIG. 27, a front perspective view of second evaporator 700 and evaporator mounting plate 404 and second compartment air duct 406 covered by first duct plate 2500 and second duct plate 1600 are shown in accordance with an illustrative embodiment. Referring to FIG. 28, an exploded, front perspective view of second evaporator 700 and evaporator mounting plate 404 and second compartment air duct 406 covered by first duct plate 2500 and second duct plate 1600 are shown in accordance with an illustrative embodiment. Referring to FIG. 29, an exploded, right-side view of second evaporator 700 and evaporator mounting plate 404 and second compartment air duct 406 covered by first duct plate 2500 and second duct plate 1600 are shown in accordance with an illustrative embodiment.

A center line 2900 indicates a vertical center through plate aperture wall 2506 and through second evaporator 700 such that the vertical center of plate aperture wall 2506 is aligned with the vertical center of second evaporator 700. As a result, air drawn through plate aperture wall 2506 is approximately from a vertical center of second evaporator 700 though this is not required. The vertical center can, for example, be positioned between an upper line 2902 and a lower line 2904. Upper line 2902 extends through a vertical upper limit that defines a first distance 2906 that is approximately 40% above a total length 2908 of second evaporator 700. Lower line 2904 extends through a vertical lower limit that defines a second distance 2910 that is approximately 40% below total length 2908 of second evaporator 700. For example, the vertical center location as well as a shape and a size of plate aperture wall 2506 can be selected based on a relative volume of the second enclosed space relative to the third enclosed space and/or based on an aperture total length 3000 of the aperture formed by plate aperture wall 2506. Though not required, it may be preferable that the aperture formed by plate aperture wall 2506 not extend outside (above/below/right/left) an extent of second evaporator 700 to avoid pulling cooled air from third compartment air duct 1100 when second fan 704 is on, but third fan 800 is off or to pull uncooled air from third compartment return duct 1102 when second fan 704 is on.

First duct plate wall 2504 blocks a remainder of air from flowing into second compartment air duct 406 so that the remainder of air flows upward into third compartment air duct 1100 when third fan 800 is on. When neither second fan 704 or third fan 800 is on, the air within the second enclosed space and the third enclosed space is generally stagnate and moves based on opening or closing of the access structure to either space and on the laws of thermodynamics such that warmer air tends to move upwards.

Plate aperture wall 2506 is also adjacent a right-side of second evaporator 700 because second fan 704 is positioned near second compartment right-side plate 512. Funnel portion 2212 transitions from a right-side of plate aperture wall 2506 to a right-side of channel portion 2214 that is approximately a width of bowl portion 2216 that is sized and shaped to provide adequate air flow from plate aperture wall 2506 to second fan 704. Of course, the described components can be arranged in other orientations based on their relative location. For example, the described vertical direction may be a horizontal direction in an alternative embodiment, and/or may be positioned on or near a left-side or a center of second evaporator 700.

A first evaporator mounting tab 901 (shown referring to FIG. 9) and a second evaporator mounting tab 903 (reference first shown referring to FIG. 9) are mounted to second evaporator 700 to extend outward in a generally perpendicular direction from a side wall of second evaporator 700. A fifth fastener aperture wall 900 (shown referring to FIG. 9) is formed through first evaporator mounting tab 901, and a sixth fastener aperture wall 902 (reference first shown referring to FIG. 9) is formed through second evaporator mounting tab 903. Second evaporator 700 may be mounted to first duct plate 2500 and to evaporator mounting plate 404 by inserting a first fastener (not shown) within first fastener aperture wall 2206, third fastener aperture wall 2516, and fifth fastener aperture wall 900 and by inserting a second fastener (not shown) within second fastener aperture wall 2208, fourth fastener aperture wall 2518, and sixth fastener aperture wall 902. For example, the first fastener and the second fastener may be a screw or rivet. Second evaporator 700 may be mounted to first duct plate 2500 and to evaporator mounting plate 404 using other types of fasteners and/or fastening methods.

Referring to FIG. 31, a block diagram of refrigerator controller 3100 is shown in accordance with an illustrative embodiment. Refrigerator controller 3100 may include an input interface 3102, an output interface 3104, a communication interface 3106, a non-transitory computer-readable medium 3108, a processor 3110, a control application 3128, and control data 3130. Fewer, different, and/or additional components may be incorporated into refrigerator controller 3100.

Input interface 3102 provides an interface for receiving information from a user or another device for entry into refrigerator controller 3100 as understood by those skilled in the art. Input interface 3102 may interface with various input technologies including, but not limited to, first temperature sensor 3112, first temperature control 3114, second temperature sensor 3116, second temperature control 3118, third temperature sensor 3120, third temperature control 3122, etc. For example, each temperature sensor may produce a sensor signal value referred to as a measured temperature value representative of a measure of the temperature in an environment to which the temperature sensor is associated. Refrigerator 100 may include various numbers of and types of sensors that measure quantities associated with operating environment of refrigerator 100 and its various compartments. Example sensor types include a pressure sensor, a temperature sensor, a fluid flow rate sensor, a voltage sensor, a current sensor, a frequency sensor, a humidity sensor, an acoustic sensor, a light sensor, a motion sensor, that may be mounted to various components of refrigerator 100.

The same interface may support both input interface 3102 and output interface 3104. The input interface technology further may be accessible by refrigerator controller 3100 through communication interface 3106.

Output interface 3104 provides an interface for outputting information for review by a user of refrigerator controller 3100 and/or for use by another application or device. For example, output interface 3104 may interface with various output technologies including, but not limited to, third fan 800, second fan 704, third fan 3126, refrigerant control 3126, etc. Refrigerator controller 3100 may have one or more output interfaces that use the same or a different output interface technology. The output interface technology further may be accessible by refrigerator controller 3100 through communication interface 3106.

Communication interface 3106 provides an interface for receiving and transmitting data between devices using various protocols, transmission technologies, and media as understood by those skilled in the art. Communication interface 3106 may support communication using various transmission media that may be wired and/or wireless. Refrigerator controller 3100 may have one or more communication interfaces that use the same or a different communication interface technology. For example, refrigerator controller 3100 may support communication using an Ethernet port, a Bluetooth antenna, a telephone jack, a USB port, etc. Data and messages may be transferred between refrigerator controller 3100 and another device using communication interface 3106. For illustration, a smart phone may send a temperature control setting value to refrigerator controller 3100.

Computer-readable medium 3108 is an electronic holding place or storage for information so the information can be accessed by processor 3110 as understood by those skilled in the art. Computer-readable medium 3108 can include, but is not limited to, any type of random access memory (RAM), any type of read only memory (ROM), any type of flash memory, etc. such as magnetic storage devices (e.g., hard disk, floppy disk, magnetic strips, . . . ), optical disks (e.g., compact disc (CD), digital versatile disc (DVD), . . . ), smart cards, flash memory devices, etc. Refrigerator controller 3100 may have one or more computer-readable media that use the same or a different memory media technology. For example, computer-readable medium 3108 may include different types of computer-readable media that may be organized hierarchically to provide efficient access to the data stored therein as understood by a person of skill in the art. As an example, a cache may be implemented in a smaller, faster memory that stores copies of data from the most frequently/recently accessed main memory locations to reduce an access latency. Refrigerator controller 3100 also may have one or more drives that support the loading of a memory media such as a CD, DVD, an external hard drive, etc. One or more external hard drives further may be connected to refrigerator controller 3100 using communication interface 3106.

Processor 3110 executes instructions as understood by those skilled in the art. The instructions may be carried out by a special purpose computer, logic circuits, or hardware circuits. Processor 3110 may be implemented in hardware and/or firmware. Processor 3110 executes an instruction, meaning it performs/controls the operations called for by that instruction. The term "execution" is the process of running an application or the carrying out of the operation called for by an instruction. The instructions may be written using one or more programming language, scripting language, assembly language, etc. Processor 3110 operably couples with input interface 3102, with output interface 3104, with communication interface 3106, and with computer-readable medium 3108 to receive, to send, and to process information. Processor 3110 may retrieve a set of instructions from a permanent memory device and copy the instructions in an executable form to a temporary memory device that is generally some form of RAM. Refrigerator controller 3100 may include a plurality of processors that use the same or a different processing technology.

Control application 3128 performs operations associated with controlling the operation of refrigerator 100 to cool the various compartments to the selected temperature. The operations may be implemented using hardware, firmware, software, or any combination of these methods. Referring to the example embodiment of FIG. 31, control application 3128 is implemented in software (comprised of computer-readable and/or computer-executable instructions) stored in computer-readable medium 3108 and accessible by processor 3110 for execution of the instructions that embody the operations of control application 3128. Control application 3128 may be written using one or more programming languages, assembly languages, scripting languages, etc.

Figure 32:
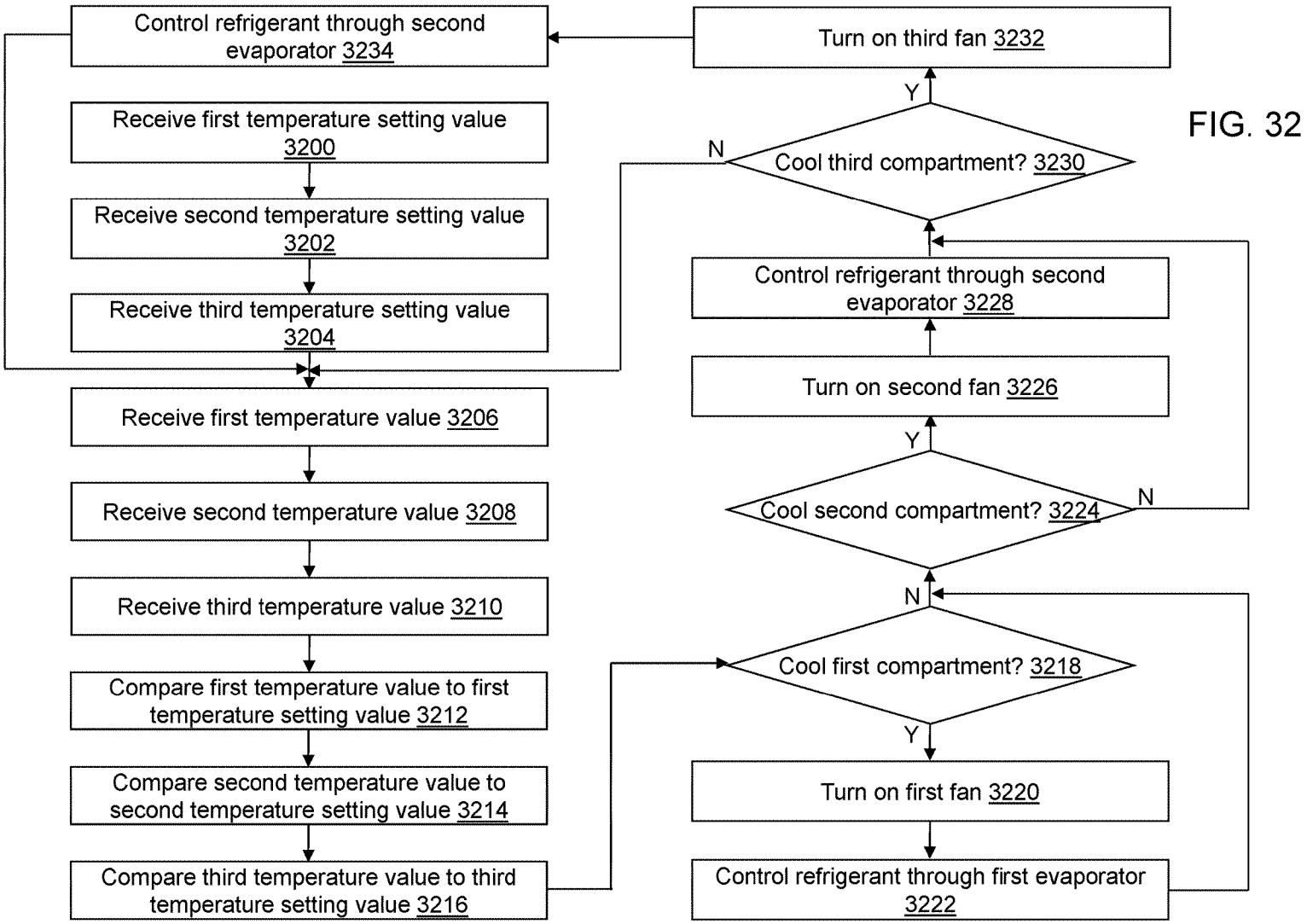
FIG. 32 depicts a flow diagram illustrating examples of operations performed by the refrigerator controller of FIG. 31 in accordance with an illustrative embodiment.

Referring to FIG. 32, example operations associated with control application 3128 are described. Additional, fewer, or different operations may be performed depending on the embodiment of control application 3128. The order of presentation of the operations of FIG. 32 is not intended to be limiting. Although some of the operational flows are presented in sequence, the various operations may be performed in various repetitions, concurrently (in parallel, for example, using threads), and/or in other orders than those that are illustrated. Control application 3128 may perform other operations, for example, associated with making ice, dispensing ice, turning on or off one or more lights, turning on or off a dryer based on a humidity level, detecting a door open or close, etc.

In an operation 3200, a first temperature setting value may be received that indicates a desired temperature setting for first compartment 102. For example, the first temperature setting value may be received from first temperature control 3114 through input interface 3102 or communication interface 3106. The first temperature setting value may be stored in control data 3130.

In an operation 3202, a second temperature setting value may be received that indicates a desired temperature setting for second compartment 104. For example, the second temperature setting value may be received from second temperature control 3118 through input interface 3102 or communication interface 3106. The third temperature setting value may be stored in control data 3130.

In an operation 3204, a third temperature setting value may be received that indicates a desired temperature setting for third compartment 106. For example, the third temperature setting value may be received from third temperature control 3122 through input interface 3102 or communication interface 3106. The third temperature setting value may be stored in control data 3130.

In an operation 3206, a first temperature value may be received that indicates a current temperature in first compartment 102. For example, the first temperature value may be received from first temperature sensor 3112 through input interface 3102 or communication interface 3106.

In an operation 3208, a second temperature value may be received that indicates a current temperature in second compartment 104. For example, the second temperature value may be received from second temperature sensor 3116 through input interface 3102 or communication interface 3106.

In an operation 3210, a third temperature value may be received that indicates a current temperature in third compartment 106. For example, the third temperature value may be received from third temperature sensor 3120 through input interface 3102 or communication interface 3106.

In an operation 3212, the first temperature value is compared to the first temperature setting value to determine if cooling is needed in first compartment 102.

In an operation 3214, the second temperature value is compared to the second temperature setting value to determine if cooling is needed in second compartment 104.

In an operation 3216, the third temperature value is compared to the third temperature setting value to determine if cooling is needed in third compartment 106.

In an operation 3218, a determination is made concerning whether or not cooling is needed in first compartment 102 based on the comparison in operation 3212. When cooling is needed in first compartment 102, processing continues in an operation 3220. When cooling is not needed in first compartment 102, processing continues in an operation 3224.

In operation 3220, first fan 3124 is turned on to circulate air through the first air circulation system.

In an operation 3222, a flow of refrigerant through the first evaporator is controlled to cool the air circulated through the first air circulation system.

In operation 3224, a determination is made concerning whether or not cooling is needed in second compartment 104 based on the comparison in operation 3214. When cooling is needed in second compartment 104, processing continues in an operation 3226. When cooling is not needed in second compartment 104, processing continues in an operation 3230.

In operation 3226, second fan 704 is turned on to circulate air through the second air circulation system. Second fan 704 draws air from second evaporator 700 through plate aperture wall 2506 and into second compartment air duct 406 where it flows downwards through second fan 704 and into second compartment 104. Return air is drawn upward through second compartment return duct 709, into third compartment return duct 1102, and into the inlet side of and over second evaporator 700 to repeat the air circulation cycle.

In the illustrative embodiment, second fan 704 draws air from approximately a right center portion of second evaporator 700 through plate aperture wall 2506. Aperture drip plate 2508 is sloped upward from the bottom edge of plate aperture wall 2506 to allow condensation from second evaporator 700 to drain into evaporator condensation tray 316 and not into second compartment air duct 406.

In an operation 3228, a flow of refrigerant through second evaporator 700 is controlled to cool the air circulated through the second air circulation system. For example, the second compressor and the second condenser are connected to receive refrigerant from second evaporator 700 through operation of various valves and/or motors also under control of control application 3128. A first compressor speed for operating the second compressor may be determined based on the comparison between the second temperature value and the second temperature setting value in operation 3214.

In operation 3230, a determination is made concerning whether or not cooling is needed in third compartment 106. based on the comparison in operation 3216. When cooling is needed in third compartment 106, processing continues in an operation 3232. When cooling is not needed in third compartment 106, processing continues in an operation 3206.

In operation 3232, third fan 800 is turned on to circulate air through the third air circulation system. Third fan 800 draws air from second evaporator 700 upwards through third compartment air duct 1100 and into third compartment 106 where the cooled air moves downward toward the plurality of vent aperture walls 712 that define the plurality of vents formed through third compartment back plate 400. The air is drawn through the plurality of vents and into third compartment return duct 1102 based on operation of third fan 800. The air is again drawn over second evaporator 700 upwards through third compartment air duct 1100 to repeat the air circulation cycle.

In an operation 3234, a flow of refrigerant through second evaporator 700 is controlled to cool the air circulated through the third air circulation system. A second compressor speed for operating the second compressor may be determined based on the comparison between the third temperature value and the third temperature setting value in operation 3216. When both second compartment 104 and third compartment 106 need cooling, a highest compressor speed may be selected from the determined first compressor speed and the determined second compressor speed. In an alternative embodiment, the second compressor may not be operated by a variable speed motor and a single compressor speed is used regardless of whether either or both of second compartment 104 and third compartment 106 need cooling. The compressor speed(s) may be defined in control data 3130 optionally as a function of a temperature difference between a measured temperature value and a temperature setting value.

Processing may continue in operation 3206 though a new temperature setting value may be received at any time, which may trigger a repeat of any of operations 3200, 3202, or 3204.

Either or both of third fan 800 and second fan 704 may be operated to defrost second evaporator 700. Any resulting condensation is received by evaporator condensation tray 316 mounted below second evaporator 700 and routed to an exterior of refrigerator body 300 through drain port 204.

When third fan 800 is on and second fan 704 is off, some air may be drawn upward through second compartment return duct 709 and into third compartment return duct 1102 from second compartment 104. Similarly, when third fan 800 is off and second fan 704 is on, some air may be drawn through the plurality of vents formed through third compartment back plate 400 and into third compartment return duct 1102 from third compartment 106. Thus, the second air circulation system and the third air circulation system share third compartment return duct 1102 and second evaporator 700 and influence each other to some extent.

An air treatment system (not shown) may be mounted in various locations of refrigerator 100 to filter air passing the third air circulation system and the second air circulation system because the air systems are linked through third compartment return duct 1102. For example, as shown in FIGS. 4 to 6, an air filter housed in an air filter housing mounted to air filter mounting plate 402 may be mounted between middle plate 301 and third compartment back plate 400 and at least partially within third compartment air duct 1100. The air treatment system may be configured to treat (e.g., purify, filter scrub, freshen, etc.) air inside second compartment 104 and third compartment 106.

The air treatment system, the second compressor, and second evaporator 700 are shared between second compartment 104 and third compartment 106 eliminating an evaporator and/or compressor to cool second compartment 104 though allowing independent control of cooling to second compartment 104.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise. The illustrative embodiments may be implemented as a method, apparatus, or article of manufacture using standard programming and/or engineering techniques to produce software, firmware, hardware, or any combination thereof to control a computer to implement the disclosed embodiments.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A refrigerator comprising:

a first evaporator;

a refrigerator controller;

a first compartment comprising a first plurality of walls;

a first compartment access structure configured to provide access to a first enclosed space defined by the first plurality of walls and the first compartment access structure; and a first temperature sensor configured to measure a first temperature value of air in the first enclosed space and to send the measured first temperature value to the refrigerator controller;

a second compartment comprising a second plurality of walls;

a second compartment access structure configured to provide access to a second enclosed space defined by the second plurality of walls and the second compartment access structure; and a second temperature sensor configured to measure a second temperature value of air in the second enclosed space and to send the measured second temperature value to the refrigerator controller;

a first fan mounted adjacent to or in the first enclosed space;

a first duct mounted between the first evaporator and the first enclosed space, the first duct comprising a first duct wall that forms a first aperture and a second aperture;

a plate mounted between the first evaporator and the first duct, the plate comprising a plate aperture wall that defines a duct aperture formed through the plate, wherein the first aperture of the first duct is adjacent the first fan, wherein the second aperture of the first duct is positioned to encompass the duct aperture, wherein a center of the duct aperture is positioned a distance from a center of the first evaporator measured in a first direction, wherein the distance is between 0% and 40% of a total length of the first evaporator in the first direction, wherein the first fan is configured to receive air from the first evaporator through the first duct and to move the received air into the first enclosed space when on;

a first return duct mounted at least partially between the first enclosed space and the first evaporator;

a second fan mounted adjacent to or in the second enclosed space;

a second duct mounted between the first evaporator and the second enclosed space, wherein the second fan is configured to receive air from the second duct and to move the received air into the second enclosed space when on; and a second return duct mounted at least partially between the second enclosed space and the first evaporator;

wherein the refrigerator controller is configured to receive the sent first temperature value;

to receive the sent second temperature value;

to control a flow of refrigerant through a coil of the first evaporator based on the received first temperature value, a first predetermined temperature set value defined for the first compartment, the received second temperature value, and a second predetermined temperature value set defined for the second compartment; and to separately control operation of the first fan and the second fan.

2. The refrigerator of claim 1, wherein the first fan is positioned adjacent a first side of a first wall of the first plurality of walls of the first compartment, and an aperture of the first return duct is positioned adjacent a second side of the first wall of the first plurality of walls of the first compartment, wherein the first side is opposite the second side.

3. The refrigerator of claim 1, wherein the plate covers a portion of the first duct and a majority of the first evaporator.

4. The refrigerator of claim 1, wherein the first compartment is located above or below the second compartment and the first direction is a vertical direction.

5. The refrigerator of claim 1, wherein the first compartment is located to the left or to the right of the second compartment and the first direction is a horizontal direction.

6. The refrigerator of claim 1, wherein the second duct and the second return duct form a continuous duct defined by a common plurality of duct walls, and the first evaporator is mounted within the continuous duct.

7. The refrigerator of claim 6, wherein the continuous duct is defined by a second plate mounted between the first evaporator and the second enclosed space, wherein the second plate is mounted on a side of the first evaporator opposite the plate, the second plate comprising a plurality of vent aperture walls that define a plurality of vents formed through the second plate, wherein the plurality of vents are positioned between the second enclosed space and the second return duct.

8. The refrigerator of claim 7, wherein the first return duct comprises a first return duct wall that forms a first aperture and a second aperture, wherein the first aperture of the first return duct wall is located in the first enclosed space and the second aperture of the first return duct wall is located in the second return duct.

9. The refrigerator of claim 8, further comprising a diverter wall positioned to divert air passing through the second aperture of the first return duct wall towards an inlet end of the first evaporator.

10. The refrigerator of claim 1, wherein the first return duct comprises a first duct wall that forms a first aperture and a second aperture, wherein the first aperture is located in the first enclosed space and the second aperture is located in the second return duct.

11. The refrigerator of claim 10, further comprising a diverter wall positioned to divert air passing through the second aperture towards an inlet end of the first evaporator.

12. The refrigerator of claim 11, wherein the second duct and the second return duct form a continuous duct defined by a common plurality of duct walls, and the first evaporator is mounted within the continuous duct.

13. The refrigerator of claim 12, wherein the continuous duct is defined by a plate mounted between the first evaporator and the second enclosed space, the plate comprising a plurality of vent aperture walls that define a plurality of vents formed through the plate, wherein the plurality of vents is positioned between the second enclosed space and the second return duct.

14. The refrigerator of claim 1, wherein the first return duct comprises a first duct wall and a second duct wall, wherein the first duct wall forms a first aperture and a second aperture, wherein the second duct wall forms a third aperture and a fourth aperture, wherein the first aperture is located in the first enclosed space and the fourth aperture is located in the second return duct, wherein the second aperture is mounted to the third aperture.

15. The refrigerator of claim 1, further comprising:

a third compartment comprising a third plurality of walls;

a third compartment access structure configured to provide access to a third enclosed space defined by the third plurality of walls and the third compartment access structure; and a third temperature sensor configured to measure a third temperature value of air in the third enclosed space and to send the measured third temperature value to the refrigerator controller;

a third fan mounted adjacent to or in the third enclosed space;

a third duct mounted between the first evaporator and the third enclosed space, wherein the third fan is configured to receive air from the third duct and to move the received air into the third enclosed space when on; and a third return duct mounted at least partially between the third enclosed space and the first evaporator;

wherein the refrigerator controller is further configured to receive the sent third temperature value;

to further control the flow of refrigerant through the coil of the first evaporator based on the received third temperature value and a third predetermined temperature set value defined for the third compartment; and to control operation of the third fan.

16. The refrigerator of claim 1, further comprising:

a first compressor connected to receive the refrigerant from the first evaporator;

wherein the refrigerator controller is further configured to control operation of the first compressor based on the received first temperature value, the first predetermined temperature set value, the received second temperature value, and the received second predetermined temperature value setting.

17. The refrigerator of claim 16, wherein controlling operation of the first compressor comprises:

determining a first compressor speed for the first compartment;

determining a second compressor speed for the second compartment; and selecting a highest compressor speed from the determined first compressor speed and the determined second compressor speed when both the first fan and the second fan are controlled on.

18. The refrigerator of claim 1, further comprising:

a second evaporator;

a third compartment comprising a third plurality of walls;

a third compartment access structure configured to provide access to a third enclosed space defined by the third plurality of walls and the third compartment access structure; and a third temperature sensor configured to measure a third temperature value of air in the third enclosed space and to send the measured third temperature value to the refrigerator controller;

a third fan mounted adjacent to or in the third enclosed space;

a third duct mounted between the second evaporator and the third enclosed space, wherein the third fan is configured to receive air from the third duct and to move the received air into the third enclosed space when on; and a third return duct mounted at least partially between the third enclosed space and the second evaporator;

wherein the refrigerator controller is further configured to receive the sent third temperature value;

to control a second flow of a second refrigerant through a coil of the second evaporator based on the received third temperature value and a third predetermined temperature set value defined for the third compartment; and to control operation of the third fan.

19. The refrigerator of claim 18, further comprising:

a first compressor connected to receive the refrigerant from the first evaporator; and a second compressor connected to receive the second refrigerant from the second evaporator;

wherein the refrigerator controller is further configured to control operation of the first compressor based on the received first temperature value, the first predetermined temperature set value, the received second temperature value, and the second predetermined temperature set value; and to control operation of the second compressor based on the received third temperature value and the third predetermined temperature set value.

20. The refrigerator of claim 1, wherein insulation is mounted between the first compartment and the second compartment.

* * * * *